US012661701B2

(12) United States Patent
Nishii et al.

(10) Patent No.: US 12,661,701 B2
(45) Date of Patent: Jun. 23, 2026

(54) SQUEEZE DEVICE

(71) Applicant: NAKATA MANUFACTURING CO., LTD., Osaka (JP)

(72) Inventors: Masato Nishii, Osaka (JP); Hiromasa Kitayama, Osaka (JP); Tomoyasu Nakano, Osaka (JP); Feizhou Wang, Osaka (JP)

(73) Assignee: NAKATA MANUFACTURING CO., LTD., Osaka (JP)

( * ) Notice: Subject to any disclaimer, the term of this patent is extended or adjusted under 35 U.S.C. 154(b) by 120 days.

(21) Appl. No.: 17/759,834

(22) PCT Filed: Jan. 4, 2021

(86) PCT No.: PCT/JP2021/000025

§ 371 (c)(1),
(2) Date: Jul. 29, 2022

(87) PCT Pub. No.: WO2021/153164

PCT Pub. Date: Aug. 5, 2021

(65) Prior Publication Data

US 2023/0028222 A1 Jan. 26, 2023

(30) Foreign Application Priority Data

Jan. 31, 2020 (JP) ..... 2020-014642

(51) Int. Cl.
*B21D 5/12* (2006.01)

(52) U.S. Cl.
CPC ..... *B21D 5/12* (2013.01)

(58) Field of Classification Search
CPC ..... B21D 5/12; B21B 31/08; B21B 31/12; B21B 31/24

(Continued)

(56) References Cited

U.S. PATENT DOCUMENTS 1,989,059 A * 1/1935 Morgan ..... B21D 5/12 72/181
2,948,324 A * 8/1960 Penrose ..... B21D 5/12 72/181

(Continued)

FOREIGN PATENT DOCUMENTS

DE 2055152 A * 11/1970 ..... B21D 5/12
JP 847-016590 B 5/1972

(Continued)

OTHER PUBLICATIONS

European Patent Office English Translation of JP-H05-76928 A by Morisono et al., (6 pages) (Year: 1993).*

(Continued)

*Primary Examiner* — Christopher L Templeton
*Assistant Examiner* — P Derek Pressley
(74) *Attorney, Agent, or Firm* — Studebaker Brackett PLLC

(57) ABSTRACT

A squeeze device for electric resistance welded pipe manufacturing is provided. In the squeeze device, a roll support plate is inserted in a manner allowing taking off of the roll support plate into a U-shaped fixed stand with an open top through the open top. The roll support plate supports right and left side rolls in a pair and an upper roll on an upstream-side main surface of a slidable surface plate, and has space for passage of a material formed at a position surrounded by these rolls. This configuration allows roll changing while leaving a mandrel in place.

7 Claims, 20 Drawing Sheets

(58) Field of Classification Search
USPC .... 72/52, 178, 179, 181, 182, 224, 225, 226
See application file for complete search history.

(56) References Cited

U.S. PATENT DOCUMENTS

| | | | | | |
|---|---|---|---|---|---|
| 2,992,318 | A | * | 7/1961 | La Tour | B23K 13/046 219/67 |
| 2005/0006351 | A1 | * | 1/2005 | Heimann | B21C 37/08 219/61.4 |

FOREIGN PATENT DOCUMENTS

| | | | | | |
|---|---|---|---|---|---|
| JP | S59-199113 | A | | 11/1984 | |
| JP | S62-270287 | A | | 11/1987 | |
| JP | 3053534 | B | * | 8/1991 | |
| JP | H04-004926 | A | | 1/1992 | |
| JP | H05-076928 | A | | 3/1993 | |
| JP | H0576928 | A | * | 3/1993 | |
| JP | H07-204736 | A | | 8/1995 | |
| JP | 08103823 | A | * | 4/1996 | |
| JP | H08-103823 | A | | 4/1996 | |
| JP | 2858601 | B2 | | 2/1999 | |
| JP | 3053534 | B2 | | 6/2000 | |
| JP | 3369475 | B2 | | 1/2003 | |
| JP | 3938918 | B2 | | 6/2007 | |
| JP | 2011235324 | A | * | 11/2011 | |
| JP | 2012-223782 | A | | 11/2012 | |
| KR | 10-2016-0068319 | A | | 6/2016 | |
| WO | WO-2012144090 | A1 | * | 10/2012 | B21D 5/12 |

OTHER PUBLICATIONS

International Search Report issued in PCT/JP2021/000025; mailed Feb. 2, 2021.

* cited by examiner

SQUEEZE DEVICE

TECHNICAL FIELD

The present invention relates to a squeeze device used in an electric resistance welded pipe manufacturing line of manufacturing a pipe continuously from a metallic material of a flat plate shape, more specifically, to a squeeze device having a simple device configuration and for which operation of roll changing is performed easily.

BACKGROUND ART

In an electric resistance welded pipe manufacturing line, an elongated steel sheet material of a flat plate shape generally called a steel strip is formed gradually into a circular cylindrical shape using a forming roll to become an open pipe. Then, opposing edge portions of the open pipe are heated by induction and the heated opposing edge portions are pressed with a squeeze roll to be joined by welding continuously, thereby manufacturing an electric resistance welded steel pipe of a round pipe shape continuously. In such an electric resistance welded pipe manufacturing line, it is common to manufacture a variety of products of different outer diameters or thicknesses. To achieve this, roll changing of changing forming rolls is frequently done.

According to arrangement of squeeze rolls in a squeeze device, it is common to use five-direction rolls having a combination of a lower roll to support an open pipe from below while the open pipe goes into the device with opposing edge portions pointed upwardly, right and left side rolls in a pair to press the open pipe from opposite sides, and right and left upper rolls in a pair to press the vicinity of the opposing edge portions from diagonally above for middle-diameter pipes of equal to or greater than 5 inches (from 5 to 12 inches) and for large-diameter pipes (equal to or greater than 13 inches). All these rolls are to be changed to rolls conforming to the size of a new product by the above-described roll changing. For small-diameter pipes of equal to or less than 4 inches, two-direction rolls or three-direction rolls are commonly used.

Operation of roll changing is required to be performed speedily particularly for roll changing of five-direction rolls as a result of its large number of rolls. In order to respond to this requirement, improvement has been made to provide squeeze devices such as those disclosed in Patent Literatures 1 to 4, for example.

In a squeeze device shown in Patent Literature 1, a body frame is placed on a base installed in a pipe manufacturing line, and a roll support plate is detachably mounted on a surface on a material entry side of the body frame. The roll support plate is provided with a pipe passage hole. A lower roll, right and left side rolls in a pair, and right and left upper rolls in a pair are mounted together with a screw down device for the upper rolls on the roll support plate in such a manner as to surround the pipe passage hole. A screw down device for the lower rolls and a screw down device for the side rolls are mounted on the base and on the body frame. Roll changing is done by causing a crane to lift the roll support plate outwardly and inwardly together with the lower roll, the right and left side rolls in a pair, the right and left upper rolls in a pair, and the screw down device for the upper rolls.

In a squeeze device shown in Patent Literature 2, a sub-frame is combined into a fixed main frame installed in a pipe manufacturing line. The sub-frame is a movable frame configured to retreat to a lateral to the pipe manufacturing line and has an inside in which a lower roll, right and left side rolls in a pair, and right and left upper rolls in a pair are supported. Screw down devices for these rolls are all mounted on the main frame. Roll changing is done by retreating the sub-frame and all the rolls supported in the sub-frame to the lateral to the pipe manufacturing line.

In a squeeze device shown in Patent Literature 3, a first roll stand is installed in a pipe manufacturing line, and a second roll stand is installed in column with the first roll stand while located downstream from the first roll stand. A lower roll and right and left side rolls in a pair are mounted in the upstream-side first roll stand. Right and left upper rolls in a pair are mounted on the downstream-side second roll stand across a roll support plate in such a manner as to overlap the upstream-side first roll stand from above. Roll changing is done by lifting the right and left upper rolls in a pair and the roll support plate together out of the second roll stand with a crane and, in this state, detaching the right and left side rolls in a pair and the lower roll upwardly from the first roll stand.

In a squeeze device shown in Patent Literature 4, of a lower roll, right and left side rolls in a pair, and right and left upper rolls in a pair, the lower roll and the right and left side rolls in a pair are combined into a fixed part installed in a pipe manufacturing line, and the right and left upper rolls in a pair are combined into a movable part overlapping the fixed part from above. The movable part is tiltable from an upright position on the fixed part to a lying position. As a result of the tilting motion to the lying position, the lower surface of the movable part and the upper surface of the fixed part are opened to allow roll changing.

In these squeeze devices allowing roll changing, while various measures are taken for performing the roll changing operation speedily, problems are still left.

For example, in the squeeze device shown in Cited Literature 1, all the five-direction rolls including the lower roll, the right and left side rolls in a pair, and the right and left upper rolls in a pair are mounted on the roll support plate, and the screw down device for the upper rolls is also mounted on the roll support plate. This increases a weight of lifting by the crane and high crane capability is required in the case of large diameter pipes. Specifically, size increase and weight increase of a facility as a whole including the crane are unavoidable.

In the squeeze device shown in Cited Literature 2, the squeeze rolls are five-direction rolls and the frame has a dual structure with the outer fixed frame and the inner movable frame combined with each other. This makes size increase, complicated configuration, and resultant weight increase of the frame unavoidable. Furthermore, as the movable sub-frame is retreated to a lateral to the pipe manufacturing line during roll changing, a place for standby and changing of the sub-frame is required to be reserved at the lateral to the pipe manufacturing line. This causes a problem of increased occupancy space.

In the squeeze device shown in Cited Literature 3, the squeeze rolls are also five-direction rolls. Moreover, as the squeeze roll stand is composed of the upper first roll stand and the lower second roll stand, size increase, complicated configuration, and resultant weight increase of the stand frame are unavoidable. Furthermore, during roll changing, the right and left upper rolls in a pair and the roll support plate are lifted up together out of the second roll stand with a crane, and in this state, the right and left side rolls in a pair and the lower roll are taken upwardly from the first roll stand. Then, rolls are assembled by following a reverse procedure. As a result, roll changing operation becomes complicated compared to the operations in the other squeeze devices.

In the squeeze device shown in Cited Literature 4, a squeeze roll stand is composed of the fixed part and the fold-down movable part so there is no need to perform a burdensome work of lifting a large-scale heavy object such as a stand frame with a crane. However, as the squeeze rolls are five-direction rolls and all these rolls are required to be lifted outwardly and inwardly with a crane, crane lifting is still required to be performed a large number of times.

As described above, the conventional squeeze device using the five-direction rolls as squeeze rolls essentially involves a large number of rolls. In addition, in the squeeze device shown in each of Cited Literatures 2 and 3, the two front and back stand frames are used to make size increase of the device unavoidable. In the squeeze device shown in each of Cited Literatures 1 and 3, the roll support plate is used. In particular, in the squeeze device disclosed in Cited Literature 1, size increase of the device is avoided effectively by combining one stand frame and one roll support plate. Meanwhile, as the roll support plate supporting the five-direction rolls is supported on the surface on the material entry side of the stand frame in a cantilever fashion, a large number of clamp devices are required to make resultant complication of the configuration unavoidable. In each of the squeeze devices using the roll support plate, the roll support plate is used for supporting not only the squeeze roll but also the screw down device to cause a problem of increasing a lifting weight more than necessary.

Besides the above-described problems, in a squeeze device, an opposing state between opposite edge portions of an open pipe 3 is adjusted using a fin-pass roll stand 2 arranged upstream from a squeeze roll 1, as shown in FIG. 20. A mandrel bar 4 is inserted downstream into the open pipe 3 from a position further upstream from the fin-pass roll 3 where opposite edge portions a steel strip are opened widely. In a region from a feeding device 6 composed of a contact chip, a work coil for welding, etc. arranged immediately in front of the squeeze roll 1 to the squeeze roll 1, heating of the opposing edge portions is facilitated by an impeder 5 mounted on the mandrel bar 4 to encourage improvement of welding efficiency.

Furthermore, in response to a pipe type to be manufactured, the mandrel bar 4 is extended further downstream. Using a bead cutter 8 mounted on a tip portion of an extension 7, a bead occurring at a welded seam part is removed by cutting.

This mandrel bar 4 essential in an electric resistance welded pipe manufacturing line reaches at least the squeeze roll 1 independently of the length of the mandrel bar 4. This disables changing of the squeeze roll 1 unless the mandrel bar 4 is separated from a support bracket 9 and moved downstream (or upstream according to the location of the support bracket) from the squeeze device. Thus, in each of the squeeze devices shown in Patent Literatures 1 to 4, operation of detaching and moving the mandrel bar 4 is required in advance in preparation for roll changing. This operation also becomes a cause for complicating roll changing operation.

PRIOR ART LITERATURES

Patent Literatures

Patent Literature 1: Japanese Patent Application Publication No. S59-199113

Patent Literature 2: Japanese Patent Application Publication No. H05-076928

Patent Literature 3: Japanese Patent Application Publication No. H08-103823

Patent Literature 4: Japanese Patent Application Publication No. 2012-223782

SUMMARY OF INVENTION

Problem to be Solved by Invention

It is an object of the present invention to provide a squeeze device of excellent workability and excellent economic efficiency allowing operation in roll changing to be performed simply, having a simple configuration, and achieving size reduction and weight reduction easily even for middle-diameter pipes and large-diameter pipes to be handled by five-direction rolls. Another object of the present invention is to provide a squeeze device that improves the quality of a manufactured pipe as well as achieving size reduction and weight reduction.

Means of Solving Problem

To fulfill the above-described objects, a squeeze device of the present invention includes:

- a U-shaped fixed stand with an open top arranged in an electric resistance welded pipe manufacturing line and in which a pipe-shaped material is to pass;
- a roll support plate composed of a slidable surface plate inserted into the U-shaped fixed stand through the open top of the U-shaped fixed stand and held in the U-shaped fixed stand in a manner allowing taking off of the roll support plate, the roll support plate supporting right and left side rolls in a pair and an upper roll on an upstream-side main surface of the surface plate in a manner allowing the side rolls and the upper roll to move in screw down directions, the upper roll having a configuration with one roll for pressing butting edge portions of the pipe-shaped material from directly above or a configuration with two rolls each for pressing the butting edge portions from diagonally above, the roll support plate having space for passage of the pipe-shaped material formed at a position surrounded by the side rolls and the upper roll without a lower roll;
- a retaining mechanism that fixes the roll support plate in the U-shaped fixed stand after the roll support plate is inserted into the U-shaped fixed stand;
- a first screw down device installed on the U-shaped fixed stand, with the roll support plate fixed in the U-shaped fixed stand, the first screw down device inwardly screwing down the right and left side rolls in a pair supported on the roll support plate; and
- a second screw down device installed on the U-shaped fixed stand, with the roll support plate fixed in the U-shaped fixed stand, the second screw down device downwardly screwing down the upper roll supported on the roll support plate.

Specifically, in the squeeze device of the present invention, a squeeze roll is composed of the right and left side rolls in a pair and the upper roll and a lower roll is omitted. Thus, even in the case of middle-diameter pipes and large-diameter pipes of equal to or greater than 5 inches for which five-direction roll stands are conventionally used, in pulling out the roll support plate upwardly from the U-shaped fixed stand, the squeeze roll does not become a hindrance to the pulling out to eliminate the need of detaching the squeeze roll. Furthermore, as the squeeze roll is supported on the upstream-side main surface of the roll support plate and the roll support plate is located downstream from the squeeze roll, an impeder inserted into a region from a position upstream from the squeeze roll to a position directly below the squeeze roll and a mandrel bar supporting the impeder do not interfere with the roll support plate to be pulled out. This also eliminates the need of detaching the mandrel bar supporting the impeder.

Furthermore, as a result of a small number of rolls in the squeeze device, the configuration of the squeeze device is essentially simple and the weight of the device, in particular, the weight of the rolls is reduced. Moreover, as a squeeze roll stand is the U-shaped fixed stand with the open top, the roll support plate can be inserted and detached through the open top. By the insertion, all the squeeze rolls and the roll support plate are placed together simultaneously in the U-shaped fixed stand. By pulling out the roll support plate upwardly from the U-shaped fixed stand, all the squeeze rolls and the roll support plate are extracted together simultaneously from the fixed stand. As a result of these, operation of roll changing is performed extremely simply.

During pipe manufacturing, the pipe-shaped material after being heated at opposite butting edge portions passes through the space formed at the roll support plate, the right and left side rolls in a pair are screwed down by the first screw down device for the side roll, and the upper roll is screwed down by the second screw down device for the upper roll. By doing so, predetermined upset force is applied to the heated butting edge portions of the pipe-shaped material.

In addition to facilitating changing of the squeeze rolls, the U-shaped fixed stand has a simple configuration and is reduced in size and weight. In particular, as the size thereof in a direction along the pipe manufacturing line is reduced, the length of the line is shortened effectively.

In the squeeze device of the present invention, the retaining mechanism for fixing the roll support plate in the U-shaped fixed stand is an open-close lid that closes the open top of the U-shaped fixed stand in a manner allowing the open top to be opened. In another case, the retaining mechanism is right and left clamp mechanisms in a pair mounted on respective side sections of the U-shaped fixed stand and engaged with respective side edges of the roll support plate inserted in the U-shaped fixed stand. These clamp mechanisms are effective in terms of weigh reduction.

Regarding the second screw down device for the upper roll, if the retaining mechanism is the open-close lid, a configuration is simplified to achieve rationality by mounting a jack-type screw down device on the open-close lid to cause the open-close lid to function as a mounting base for the screw down device. If the retaining mechanism is the right and left clamp mechanisms in a pair, a configuration is simplified to achieve rationality by mounting a jack-type screw down device, particularly, a main body thereof on a slidable upper roll mounting plate supported in such a manner as to be movable up and down along one main surface of the roll support plate and by forming a driving mechanism for the main body on the side of an opposite surface of the roll support plate or on the side of an opposite surface from the roll support plate to the U-shaped fixed stand.

The space for passage of the pipe-shaped material is formed at the roll support plate at the position surrounded by the right and left side rolls in a pair and the upper roll. While the space may be a through hole enclosed along its periphery, it is particularly preferably space forming a part of a cutout-shaped opening opened downwardly from the roll support plate. If the space of the roll support plate for passage of the pipe-shaped material is a part of the cutout-shaped opening opened downwardly, an extended mandrel bar for an inner bead cutter also passes through the cutout-shaped opening and does not hinder upward movement of the roll support plate during roll changing. This eliminates the need of attaching and detaching the extended mandrel bar for an inner bead cutter.

Regarding the squeeze roll in the squeeze device of the present invention, the upper roll may have a configuration with one roll (single type) for pressing the butting edge portions of the pipe-shaped material from directly above or a configuration with two rolls (split type) each for pressing the butting edge portions from diagonally above. If the upper roll is composed of one roll, three-direction rolls are prepared in total as the squeeze roll. If the upper roll is composed of two rolls, four-direction rolls are prepared. In either case, a configuration is simplified and a weight is reduced compared to five-direction rolls. Three-direction rolls are preferred for small-diameter pipes or middle-diameter pipes. Four-direction rolls are preferred for middle-diameter pipes or large-diameter pipes.

While each of the right and left side rolls in a pair may be a vertical roll with a corresponding vertical roll shaft, it is more desirably a tilted roll with a corresponding roll shaft tilted outwardly toward a higher position. Specifically, a lower roll is absent in the squeeze device of the present invention. Thus, if the side roll is a vertical roll, the vertical roll is a different-diameter caliber roll in which a lower flange has a larger diameter than an upper flange for the need of supporting the pipe-shaped material from below. Hence, the weight of the roll is increased and a roll scar is caused easily by a difference in peripheral speed resulting from the increased diameter of the lower flange. Additionally, downward thrust force is applied to the side roll. In addition to the increased diameter of the lower flange, increasing a roll diameter is unavoidable from the viewpoint of preventing interference between the vertical side roll shaft and an upper roll shaft at a higher position. The increased roll diameter causes increase in a forming zone in the pipe manufacturing line, causing a problem that a distance is increased from a position of feeding by a contact chip, a work coil for welding, etc. to a welding point.

In this regard, tilting the support shaft for each of the right and left side rolls in a pair outwardly toward a higher position eliminates the need of forming the lower flange into a large diameter. Specifically, the upper and lower flanges are allowed to have an equal diameter. This tilt makes it unlikely that the side roll shaft will interfere with the upper roll shaft at a higher position. This also contributes to fulfillment of the diameter reduction of the side roll. As a result of reduction in the side roll diameter including formation of the upper and lower flanges into an equal diameter realized by reducing the diameter of the lower flange, the weight of the roll can be reduced, the occurrence of a roll scar can be prevented, and a distance from the work coil for welding to the welding point can be shortened, thereby achieving reduction in size and weight of the device and improvement of the quality of a manufactured pipe. Furthermore, forming the upper and lower flanges into an equal diameter makes a roll caliber symmetric about a roll shaft direction to cancel thrust force. This also allows size reduction and extended lifetime of a bearing supporting the side roll. The tilted roll supporting the pipe-shaped material from diagonally below is effective, particularly for middle-diameter pipes or large-diameter pipes.

Advantageous Effects of Invention

According to the squeeze device of the present invention, by combining the U-shaped fixed stand and the roll support plate composed of the slidable surface plate inserted into the U-shaped fixed stand from above and held in the U-shaped fixed stand and supporting the right and left side rolls in a pair and the upper roll on one main surface thereof, simplification of the device configuration and reduction in size and weight of the device are encouraged. Furthermore, by improving workability during roll changing significantly, it becomes possible to improve economic efficiency and workability considerably.

By taking advantage of the absence of a lower roll, a part of the cutout-shaped opening opened downwardly from the roll support plate is defined as the space for passage of the pipe-shaped material formed at the roll support plate. By doing so, even if an inner bead cutter is used, work of roll changing can be done without attaching and detaching a mandrel bar for this cutter to achieve further improved workability during roll changing. Likewise, by taking advantage of the absence of a lower roll, each of the right and left side rolls in a pair is formed as a tilted roll with a corresponding support shaft tilted outwardly toward a higher position. By doing so, the weight of the roll can be reduced, the occurrence of a roll scar can be prevented, and a distance from the work coil for welding to the welding point can be shortened, thereby achieving reduction in size and weight of the device and improvement of the quality of a manufactured pipe. Furthermore, reducing thrust force allows size reduction and extended lifetime of a bearing supporting the side roll.

EMBODIMENTS FOR CARRYING OUT INVENTION

Figure 1:
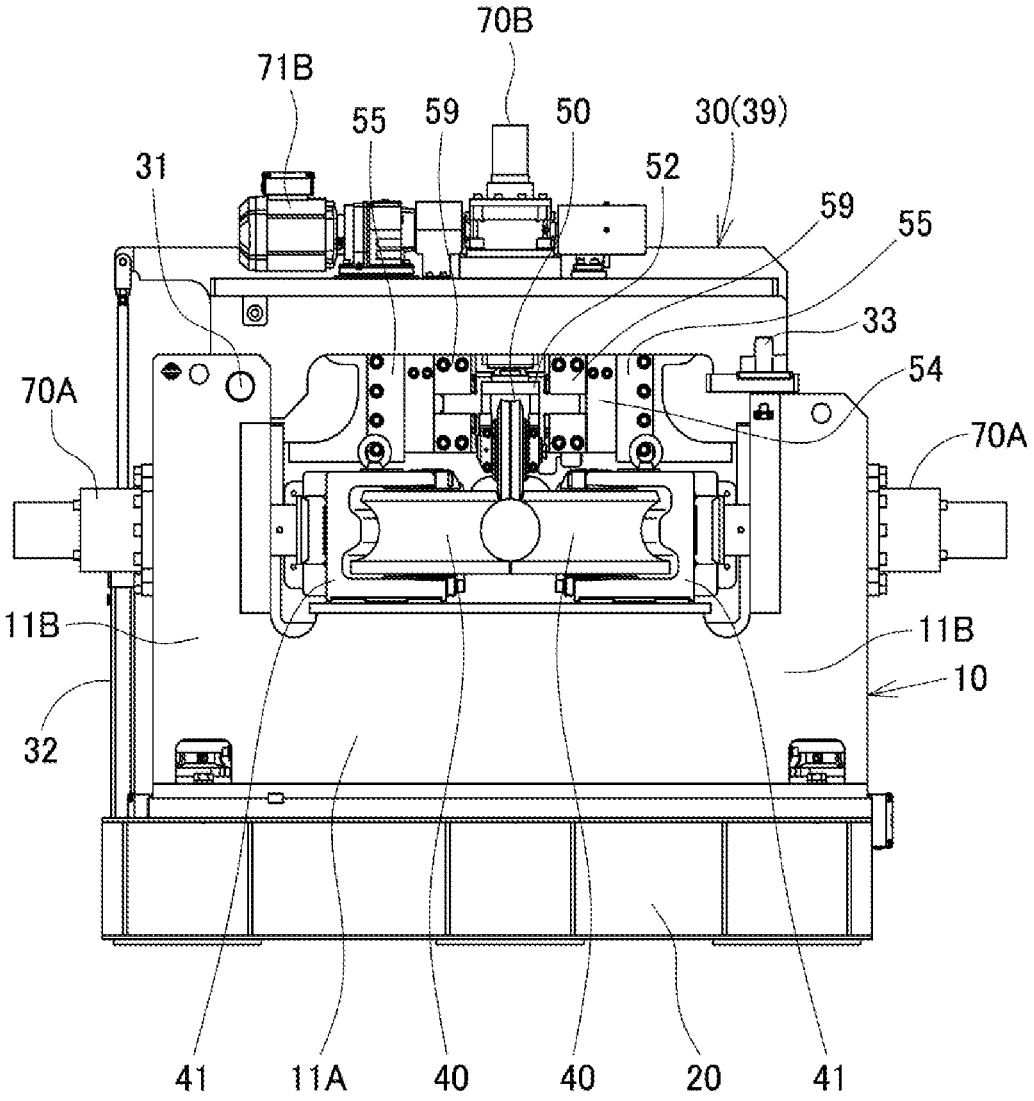
FIG. 1 is a front view of a squeeze device showing a first embodiment of the present invention and is a view from a line upstream side.

Embodiments of the present invention will be described below in the order from a first embodiment, a second embodiment, and a third embodiment.

As shown in FIGS. 1 to 7, a squeeze device of the first embodiment is a squeeze roll stand arranged at a welding part of an electric resistance welded steel pipe manufacturing line. The squeeze device include: a U-shaped fixed stand 10 arranged at the welding part and in which a pipe-shaped material after subjected to forming is to pass; and a squeeze roll unit detachably placed in the U-shaped fixed stand 10.

The U-shaped fixed stand 10 has a U-shape composed of a horizontal lower section 11A and vertical opposite side sections 11B, 11B, and is installed in its entirety on a fixed base 20. The U-shaped fixed stand 10 is equipped with a retaining mechanism 30 for fixing the squeeze roll unit in the U-shaped fixed stand 10 after the squeeze roll unit is placed in the U-shaped fixed stand 10. Here, the retaining mechanism 30 is an open-close lid 39 for opening and closing an open top of the U-shaped fixed stand 10. The open-close lid 39 is a member corresponding to the absent horizontal top of the U-shaped fixed stand 10. The open-close lid 39 has one end portion opened and closed by a hinge structure pivotally supported by a support shaft 31 on the side section 11B on one side, mechanically opened and closed using a cylinder 32 mounted vertically and outwardly on the side section 11B also on the one side, and fixed in an open state (see FIG. 6). With the open top of the U-shaped fixed stand 10 in a closed state, the other end portion of the open-close lid 39 is engaged using a lock mechanism 33 also provided on the upper surface of the side section 11B on the other side to be fixed in a closed state.

Figure 7:
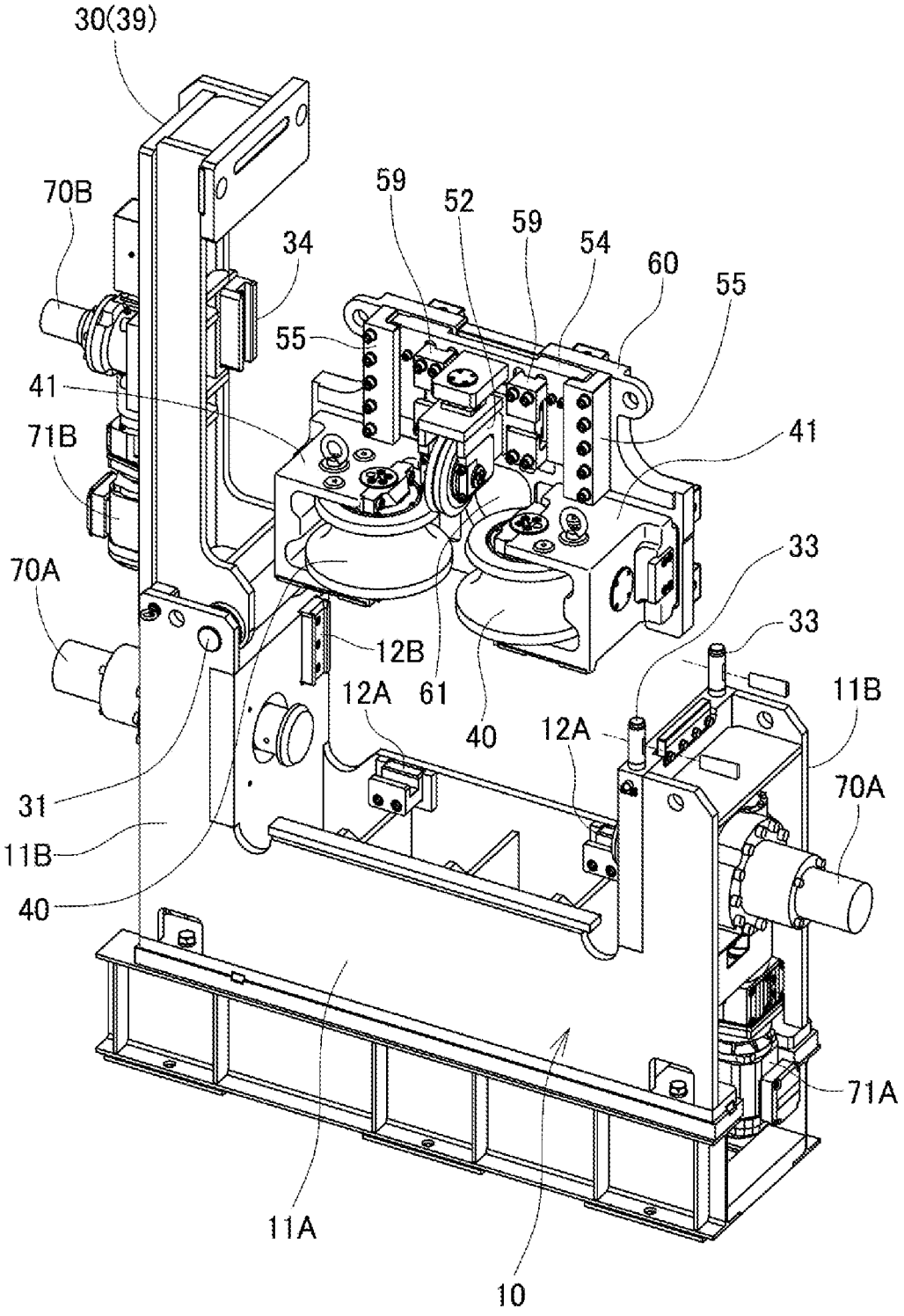
FIG. 7 is a perspective view of the squeeze device from the front showing a state where a roll support plate is ejected upwardly.
Figure 8:
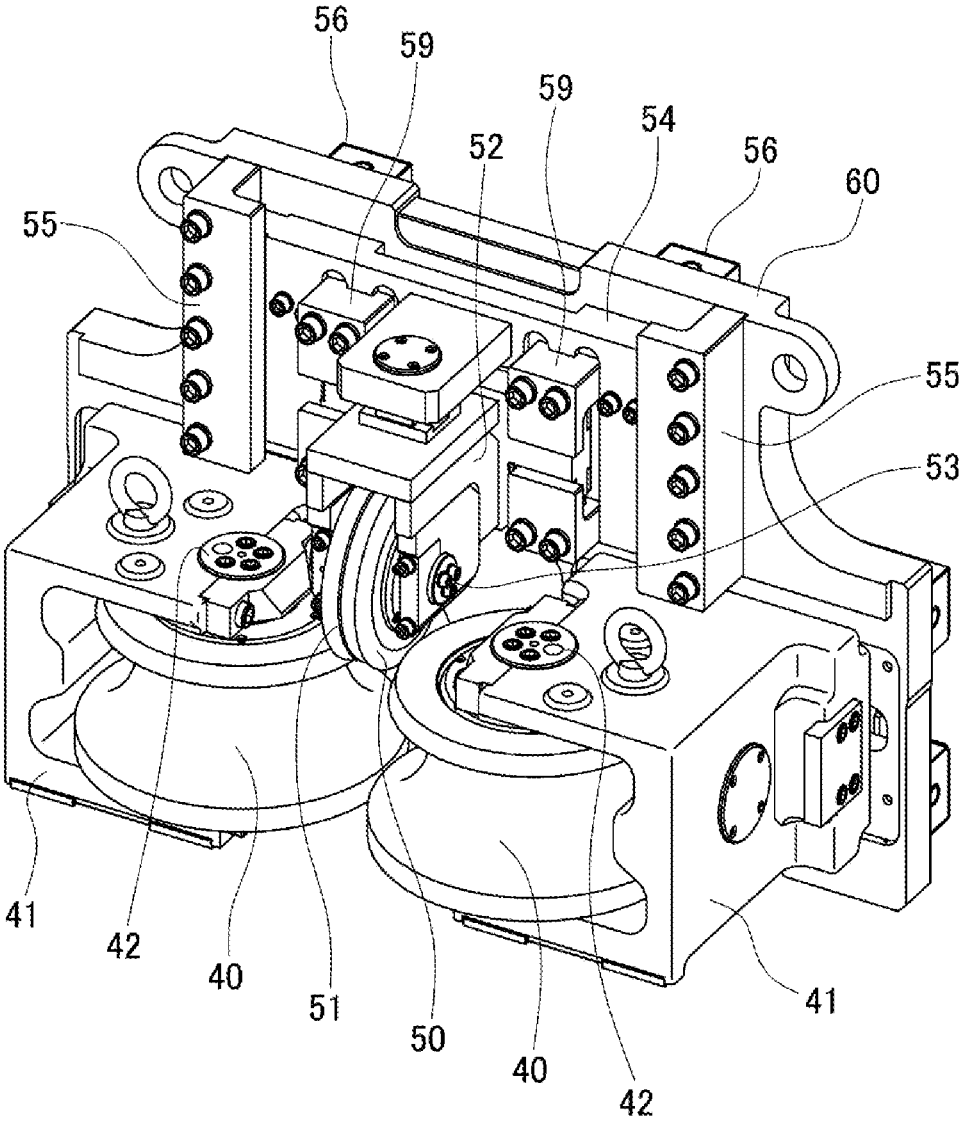
FIG. 8 is an enlarged perspective view of the roll support plate from the front.
Figure 9:
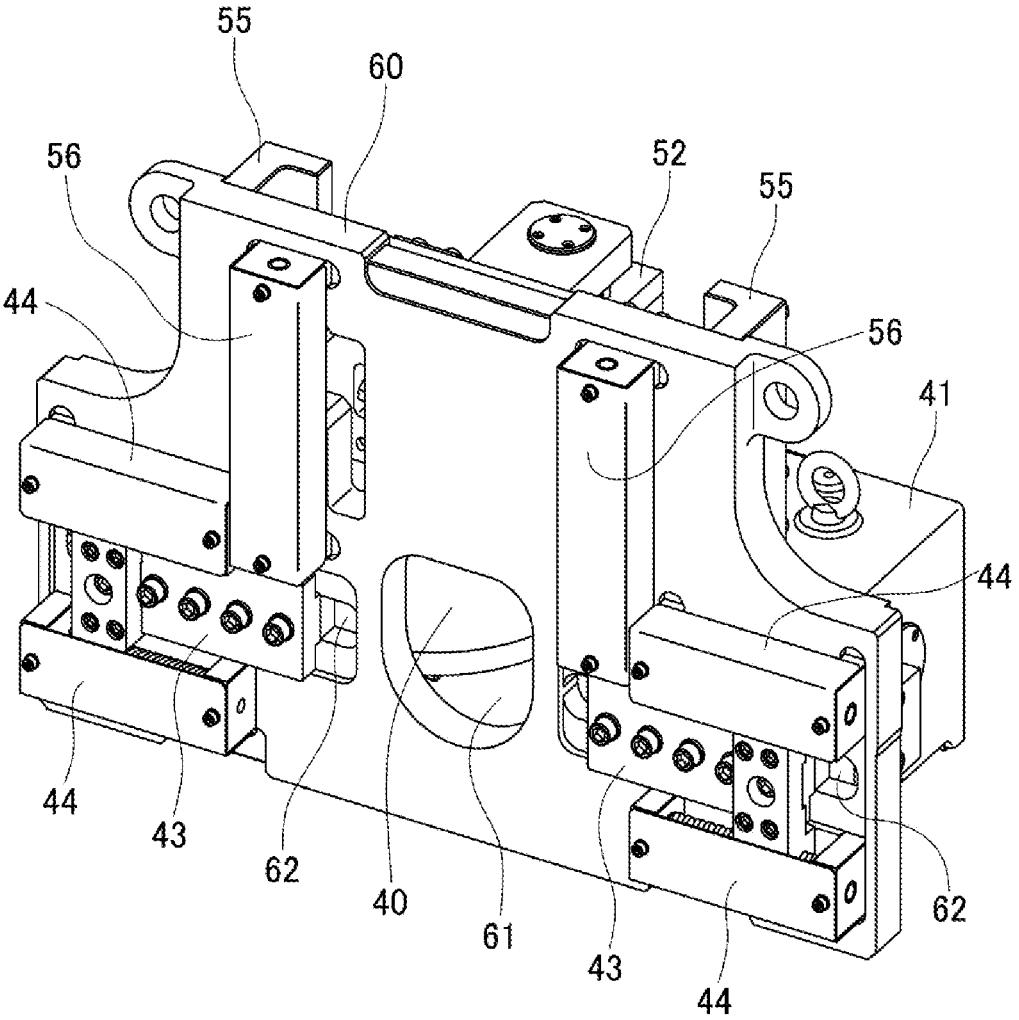
FIG. 9 is an enlarged perspective view of the roll support plate from the back.

As shown in FIGS. 8 and 9, the squeeze roll unit placed in the U-shaped fixed stand 10 has a three-roll configuration including a combination of side rolls 40, 40 on opposite sides and a single upper roll 50, and includes a roll support plate 60 of a vertical surface plate shape supporting these squeeze rolls on the front side. The roll support plate 60 is a slide plate to be inserted by crane lifting into the U-shaped fixed stand 10 and to be pulled up upwardly from the inside of the U-shaped fixed stand 10 with the side rolls 40, 40 on the opposite sides and the upper roll 50 supported on the roll support plate 60 on the front side. The roll support plate 60 in the inserted state is fixed in a top-bottom direction with the open-close lid 39 installed on the U-shaped fixed stand 10. As shown in FIG. 7, the roll support plate 60 is fixed in a direction of the pipe manufacturing line with a first engagement part 34 mounted on the rear surface of the open-close lid 39, right and left second engagement parts 12A, 12A in a pair mounted on the upper surface of the lower section 11A of the U-shaped fixed stand 10, and third engagement parts 12B, 12B mounted on the respective inner side surfaces of the side sections 11B, 11B on the opposite sides and functioning as slide guides in a vertical direction.

Figure 2:
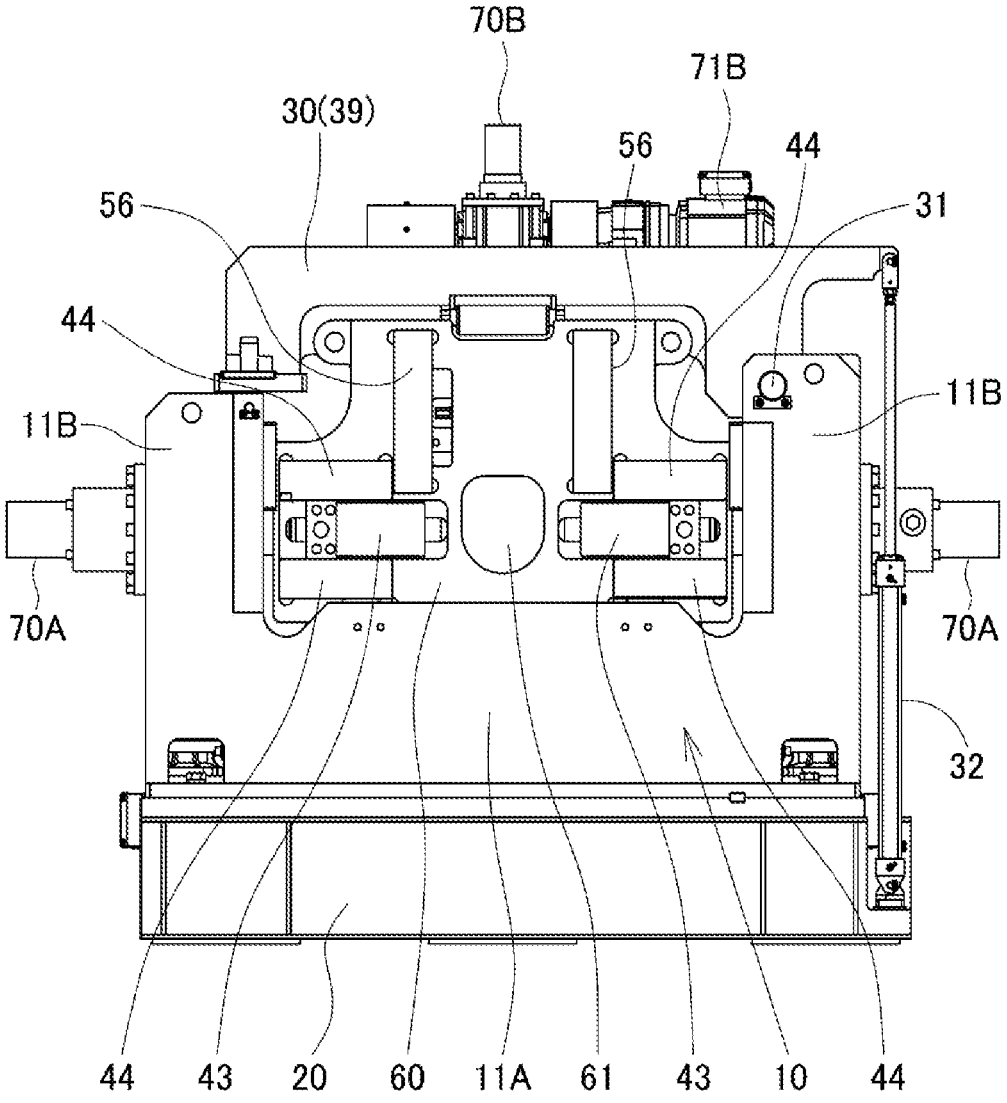
FIG. 2 is a back view of the squeeze device.
Figure 3:
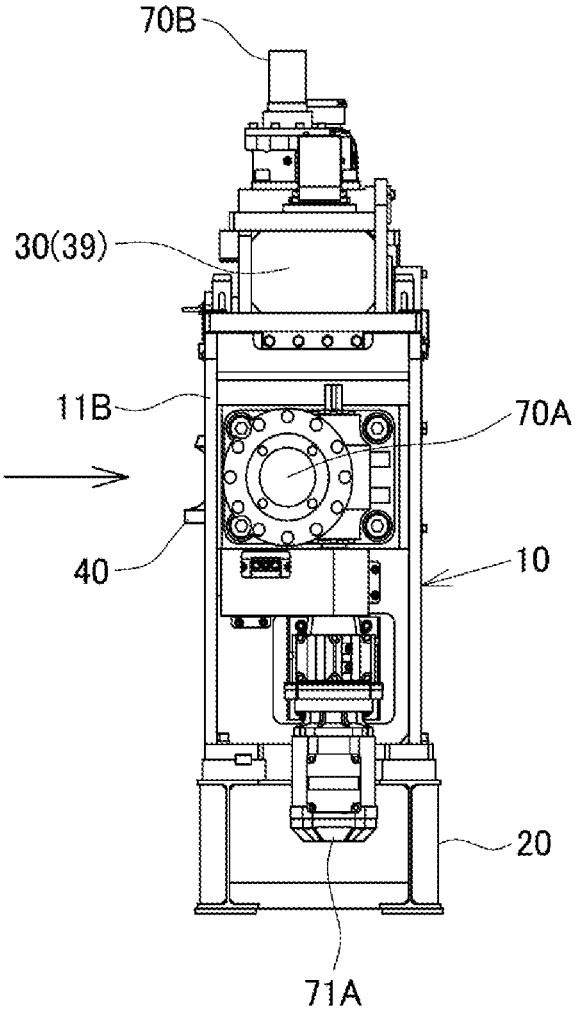
FIG. 3 is a side view of the squeeze device.
Figure 4:
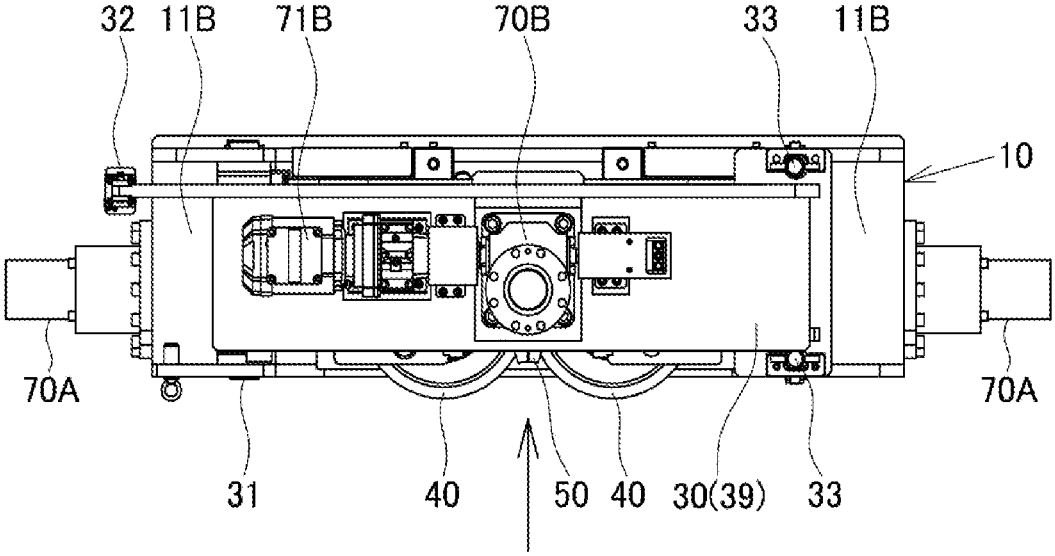
FIG. 4 is a plan view of the squeeze device.
Figure 5:
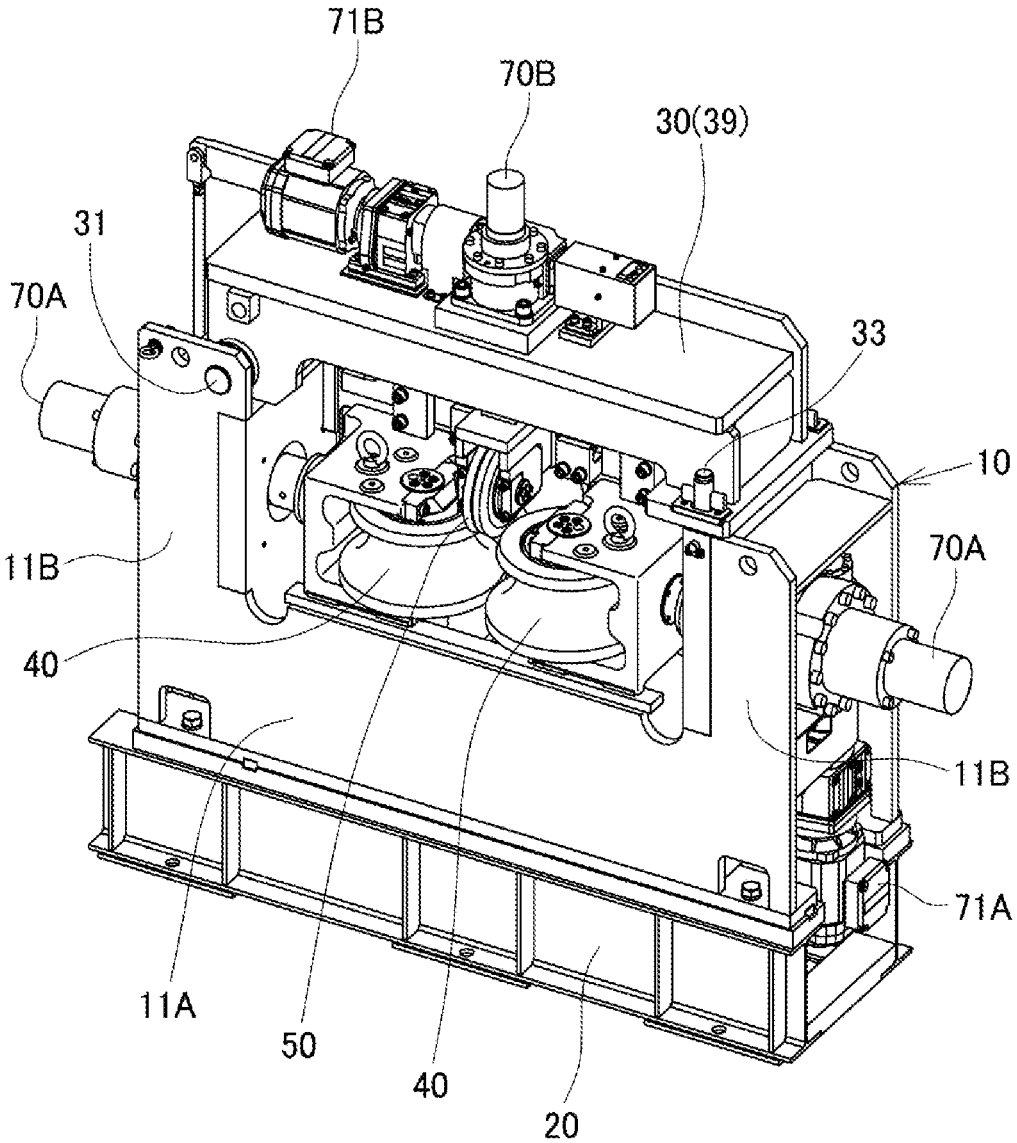
FIG. 5 is a perspective view of the squeeze device from the front.
Figure 6:
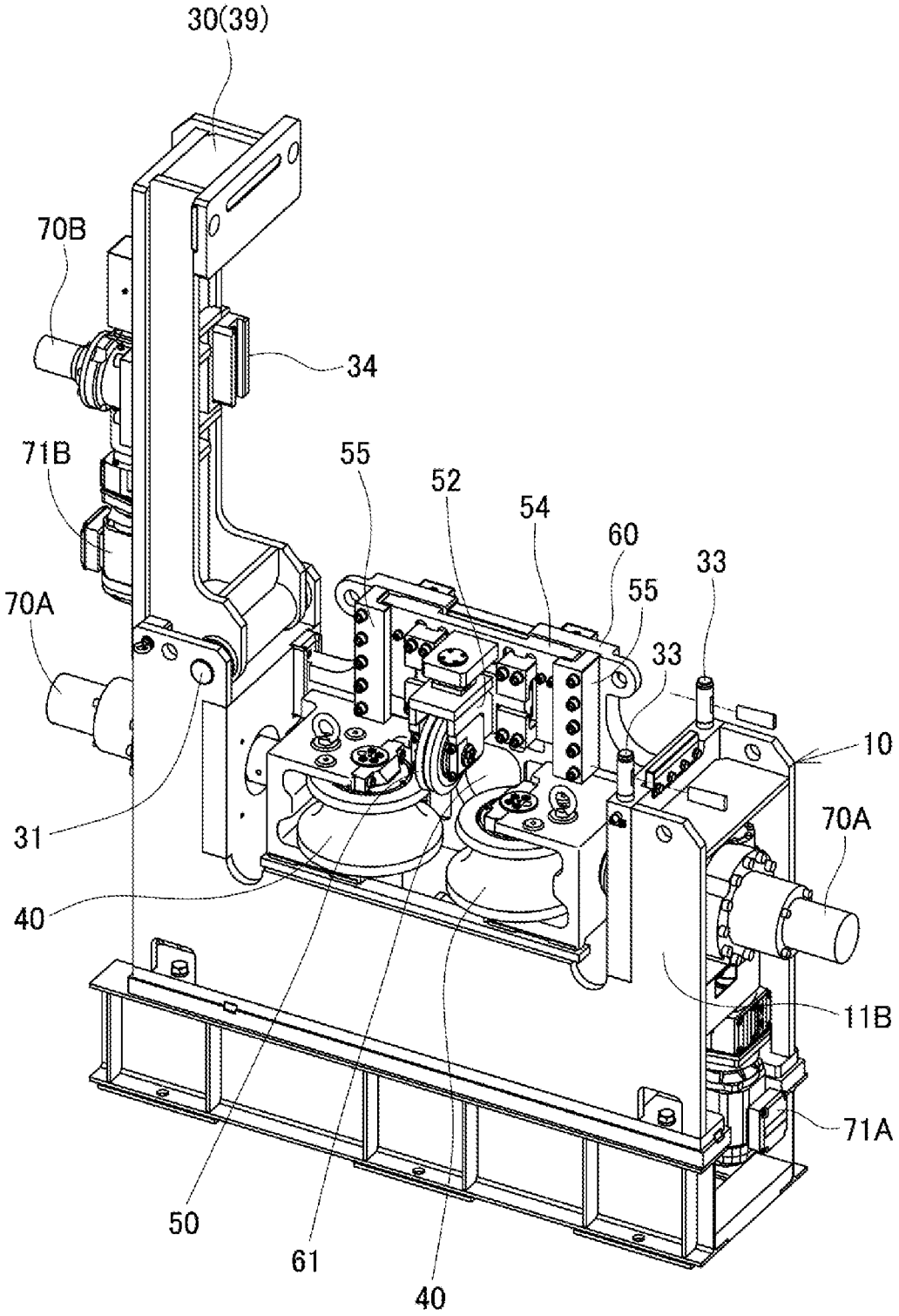
FIG. 6 is a perspective view of the squeeze device from the front showing a state where an open-close lid is opened.

As clearly shown in FIGS. 2 and 9, the roll support plate 60 has space 61 for passage of a pipe-shaped material provided in an area crossing the pipe manufacturing line, specifically, an area surrounded by the side rolls 40, 40 on the opposite sides and the upper roll 50. The space 61 is a through hole enclosed along its entire periphery.

Of the rolls supported on the front side of the roll support plate 60, each of the side rolls 40, 40 on the opposite sides is a horizontal roll rotatably supported by a vertical support shaft 42 on a roll yoke 41 opened in two directions toward the front and toward the inside, more specifically, is a different-diameter roll in which a lower flange has a larger diameter than an upper flange for supporting the pipe-shaped material from below. The roll yoke 41 is fastened with a bolt to a slide block 43 fitted in a horizontally-long guide hole 62 formed at the roll support plate 60. The slide block 43 is elastically held outwardly by upper and lower return mechanisms 44, 44 in a pair with built-in horizontal springs mounted on the back surface of the roll support plate 60. By doing so, each side roll 40 is biased outwardly in a manner attachable and detachable to and from the roll support plate 60 and movable in a horizontal direction.

Here, the upper roll 50 is a single vertical roll and has an annular groove 51 formed at a central part thereof for avoiding interference with a weld bead of the pipe-shaped material. The upper roll 50 is rotatably supported by a horizontal support shaft 53 on a roll yoke 52 opened in two directions toward the front and toward the bottom. The roll yoke 52 is mounted in a manner slidable in a lateral direction by a fixture 59 further functioning as a guide on a slidable upper roll mounting plate 54 arranged as a sub surface plate on the front side of the roll support plate 60 as a main surface plate. Using an adjusting screw not shown in the drawings, the position of the roll yoke 52 in the lateral direction is adjusted. The upper roll mounting plate 54 is supported in a manner slidable in a top-bottom direction by vertical guides 55, 55 on opposite sides and is elastically held upwardly by return mechanisms 56, 56 with built-in vertical springs mounted on the back surface of the roll support plate 60. By doing so, the upper roll 50 is biased outwardly in a manner attachable and detachable to and from the roll support plate 60 and movable in a top-bottom direction.

First screw down devices 70A, 70A in a pair for the corresponding side rolls 40, 40 on the opposite sides are inwardly mounted on the side sections 11B, 11B on the opposite sides of the U-shaped fixed stand 10 while penetrating the side sections 11B, 11B. A second screw down device 70B for the upper roll 50 is inwardly mounted on the open-close lid 39 installed on the U-shaped fixed stand 10 while penetrating the open-close lid 39.

The first screw down device 70A is driven by a motor 71A mounted together with this screw down device 70A on the side section 13B to change a position of restraining the side roll 40 with the bracket 41, thereby adjusting a screw down amount of the side roll 40. The second screw down device 70B is driven by a motor 71B mounted together with the screw down device 70B on the open-close lid 39 to change a position of restraining the upper roll 50 with the bracket 52, thereby adjusting a screw down amount of the upper roll 50. While the open-close lid 39 mentioned herein is the retaining mechanism 30 for the roll support plate 60 of the squeeze roll unit, it further functions as a mounting base for the second screw down device 70B.

The squeeze device of the first embodiment having the above-described configuration is used and functions as follows.

This squeeze device is installed with its front pointed toward a line upstream side. Then, with the open-close lid 39 as the retaining mechanisms 30 installed on the U-shaped fixed stand 10 in an open state, the roll support plate 60 is inserted into the U-shaped fixed stand 10, thereby placing the side rolls 40, 40 on the opposite sides and the upper roll 50 in the U-shaped fixed stand 10. Next, the open-close lid 39 is fixed in a closed state. In this state, a pipe-shaped material with heated butting edge portions goes into the squeeze device from the front and the butting edge portions are pressed with the side rolls 40, 40 on the opposite sides and the upper roll 50 to predetermined screw down amounts to be welded.

At this time, the pipe-shaped material passes through the space 61 of the roll support plate 60. A mandrel bar for inner bead cutting is placed in the space 61 while being located inside the pipe-shaped material. The side rolls 40, 40 on the opposite sides are subjected to setting of predetermined screw down amounts against biasing force made by the first screw down devices 70A, 70A on the opposite sides. The upper roll 50 is subjected to setting of a predetermined screw down amount against biasing force made by the second screw down device 70B mounted on the open-close lid 39.

For roll changing, after the pipe-shaped material goes out of the squeeze device, the screw down by the first screw down devices 70A, 70A is removed and the screw down by the second screw down device 70B is removed. This makes the side rolls 40, 40 on the opposite sides return to outer initial positions and makes the upper roll 50 return to an upper initial position. Then, the open-close lid 39 installed on the U-shaped fixed stand 10 is operated to move to an open state to open the open top of the U-shaped fixed stand 10. Then, the roll support plate 60 is lifted with a crane to take the side rolls 40, 40 on the opposite sides, the upper roll 50, and the roll support plate 60 together out of the U-shaped fixed stand 10.

At this time, as the side rolls 40, 40 on the opposite sides and the upper roll 50 as squeeze rolls are supported upstream from the roll support plate 60, the roll support plate 60 is located downstream from the squeeze rolls. Thus, if the mandrel bar is dedicated to an impeder, a tip of the mandrel bar only reaches as far as the squeeze rolls to cause no interference between the roll support plate 60 and the mandrel bar, thereby eliminating the need of detaching the mandrel bar. If the mandrel bar is for an impeder and for an inner bead cutter, this mandrel bar is removed from a support bracket and pulled out of the space 61 of the roll support plate 60. Then, the roll support plate 60 is lifted. Next, the roll support plate 60 on which different side rolls 40, 40 and a different upper roll 50 are supported is lifted with a crane and placed in the U-shaped fixed stand 10. In this way, all the rolls of the squeeze roll stand are changed only by lifting the roll support plate 60 up and down using the crane.

After the roll support plate 60 is placed in the U-shaped fixed stand 10, the open-close lid 39 installed on the U-shaped fixed stand 10 is fixed to a closed state. By doing so, the roll support plate 60 is fixed firmly inside the fixed stand 10 with the third engagement part 34 mounted on the rear surface of the open-close lid 39, the second engagement parts 12B, 12B mounted on the respective inner side surfaces of the side sections 11B, 11B on the opposite sides and functioning as slide guides in a vertical direction, and the right and left first engagement parts 12A, 12A in a pair mounted on the upper surface of the lower section 11A.

At the roll support plate 60 taken out of the U-shaped fixed stand 10, bolts are loosened to detach the side rolls 40, 40 together with the brackets 41, 41 and the slide blocks 43, 43 from the roll support plate 60. Furthermore, the upper roll 50 is detached together with the bracket 52 from the slidable upper roll mounting plate 54. As a result, changing to the different side rolls 40, 40 and the different upper roll 50 is done simply. The first screw down devices 77A, 70A and the second screw down device 70B installed on the U-shaped fixed stand 10 are configured to adjust screw down amounts freely, so that these screw down devices are commonly usable for any type of the side rolls 40, 40 and any type of the upper roll 50.

As described above, in the squeeze device of the first embodiment, roll changing of the side rolls 40, 40 and the upper roll 50 is done extremely easily. As the squeeze roll has a three-direction roll configuration including the side rolls 40, 40 and the upper roll 50, the device configuration is simplified. As the roll support plate 60 supporting the squeeze on the front side is supported firmly in the U-shaped fixed stand 10 in cooperation with the open-close lid 39, a clamp mechanism for this fixation is not required. This further facilitates simplification of the device configuration.

Figure 10:
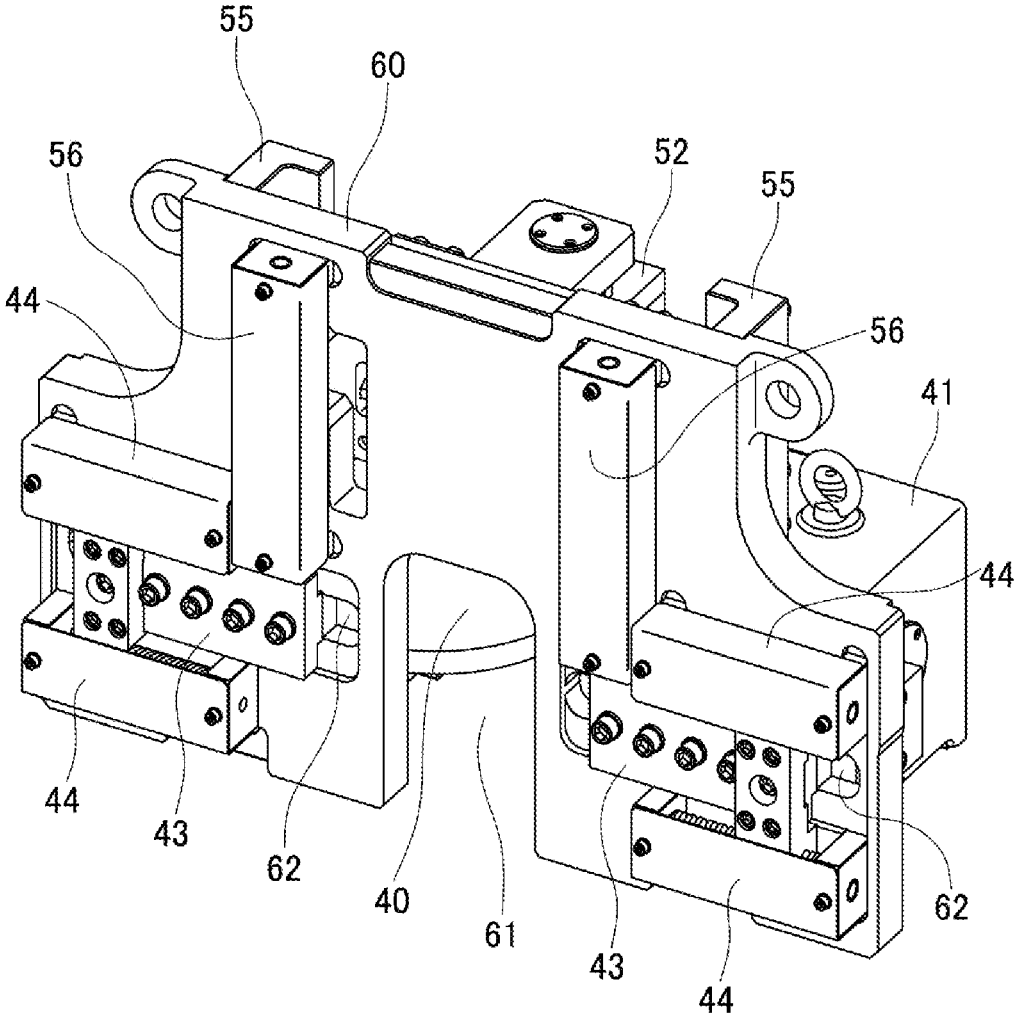
FIG. 10 is an enlarged perspective view of a squeeze roll unit from the back showing a second embodiment of the present invention.
Figure 11:
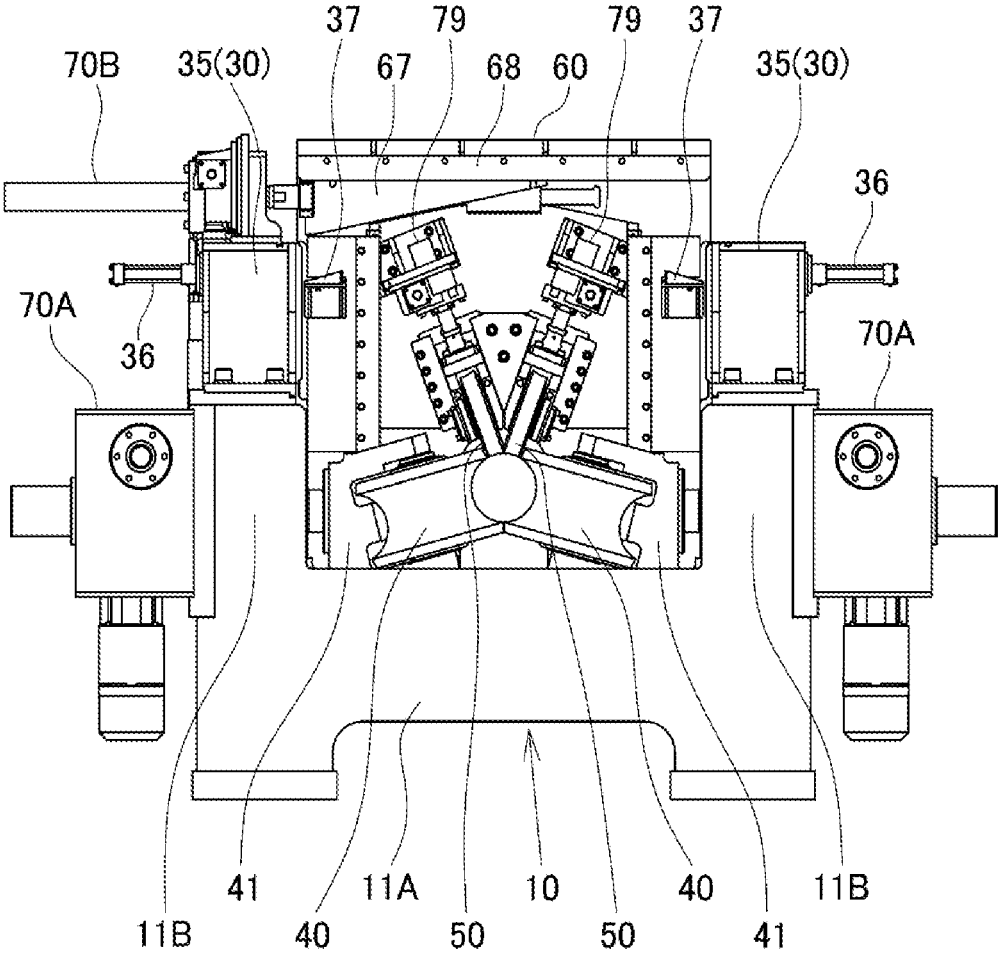
FIG. 11 is a front view of a squeeze device showing a third embodiment of the present invention and is a view from a line upstream side.

The second embodiment of the present invention will be described next. As shown in FIG. 10, in a squeeze device of the second embodiment, the roll support plate 60 has a different shape compared to the squeeze device of the first embodiment described above. More specifically, the space 61 for passage of a pipe-shaped material is changed from the through hole enclosed along its entire periphery to a part of a cutout-shaped opening opened downwardly. The other structures are substantially equal to those of the squeeze device of the first embodiment. An equal part will be given the same sign and will not be described.

Specifically, in the squeeze device of the second embodiment, the space 61 of the roll support plate 60 for passage of the pipe-shaped material is a part (here, an upper part) of the cutout-shaped opening opened downwardly. Furthermore, like in the squeeze device of the first embodiment, a squeeze roll is composed of the side rolls 40, 40 on the opposite sides and the upper roll 50 and a lower roll is omitted. This certainly eliminates the need of detaching a mandrel bar for an impeder and also eliminates the need of detaching a mandrel bar for an impeder and for an inner bead cutter placed in the space 51 during roll changing. As a result, operation of the roll changing is simplified further.

A lower roll as a squeeze roll is omitted from each of the squeeze device of the first embodiment and the squeeze device of the second embodiment. However, as each of the side rolls 40, 40 is a different-diameter roll in which a lower part has a larger diameter than an upper part, the pipe-shaped material is still supported from below.

The third embodiment of the present invention will be described next. A squeeze device of the third embodiment differs from the squeeze device of the first embodiment and the squeeze device of the second embodiment described above mainly in the side rolls 40, 40 on the opposite sides and the upper roll 50 as squeeze rolls, the roll support plate 60 supporting these rolls, the retaining mechanism 30 that fixes the roll support plate 60 inside the U-shaped fixed stand 10 in a top-bottom direction, and the second screw down device 70B that screws down the upper roll 50.

The configuration of the squeeze device of the third embodiment will be described in detail below. As shown in FIGS. 11 to 17, this squeeze device includes a U-shaped fixed stand 10 similar to that described above, and a squeeze roll unit detachably placed in the U-shaped fixed stand 10. The squeeze roll unit has a four-roll configuration including a combination of the side rolls 40, 40 on opposite sides and split-type upper rolls 50, 50 that press opposite edge portions of a pipe-shaped material from diagonally above. These squeeze rolls are supported on the front side of the roll support plate 60 of a slidable type having a vertical surface plate shape. Together with the roll support plate 60, these squeeze rolls are inserted into the U-shaped fixed stand 10 and pulled up upwardly from the inside of the U-shaped fixed stand 10 by crane lifting.

Of a group of the rolls supported on the front side of the roll support plate 60, the side rolls 40, 40 on the opposite sides are each an equal-diameter roll in which an upper part and a lower part are equal in outer diameter, and are rotatably supported on the roll yokes 41, 41 on the opposite sides by the support shafts 42, 42 tilted outwardly toward a higher position. Specifically, the side rolls 40, 40 of this case are tilted rolls with the respective support shafts 42, 42 tilted outwardly toward a higher position.

Figure 18:
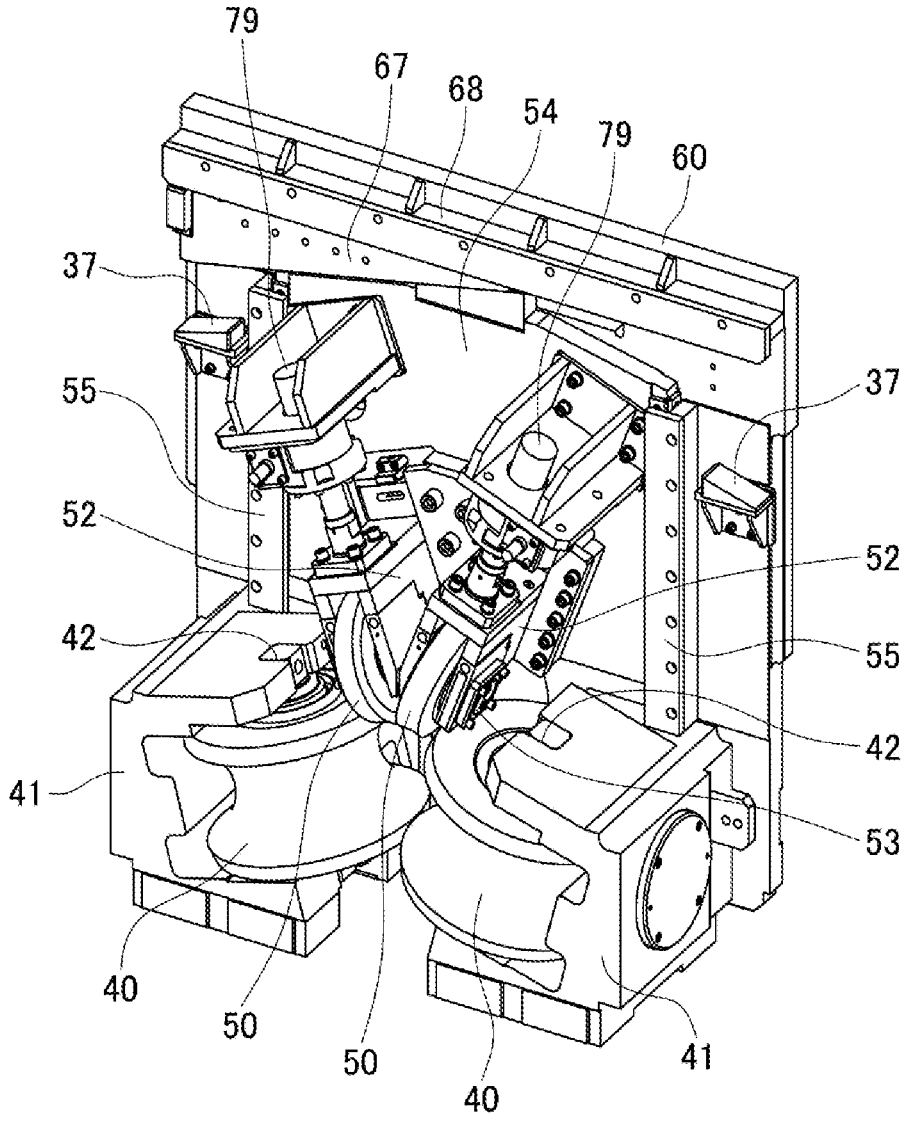
FIG. 18 is an enlarged perspective view of the roll support plate from the front.
Figure 19:
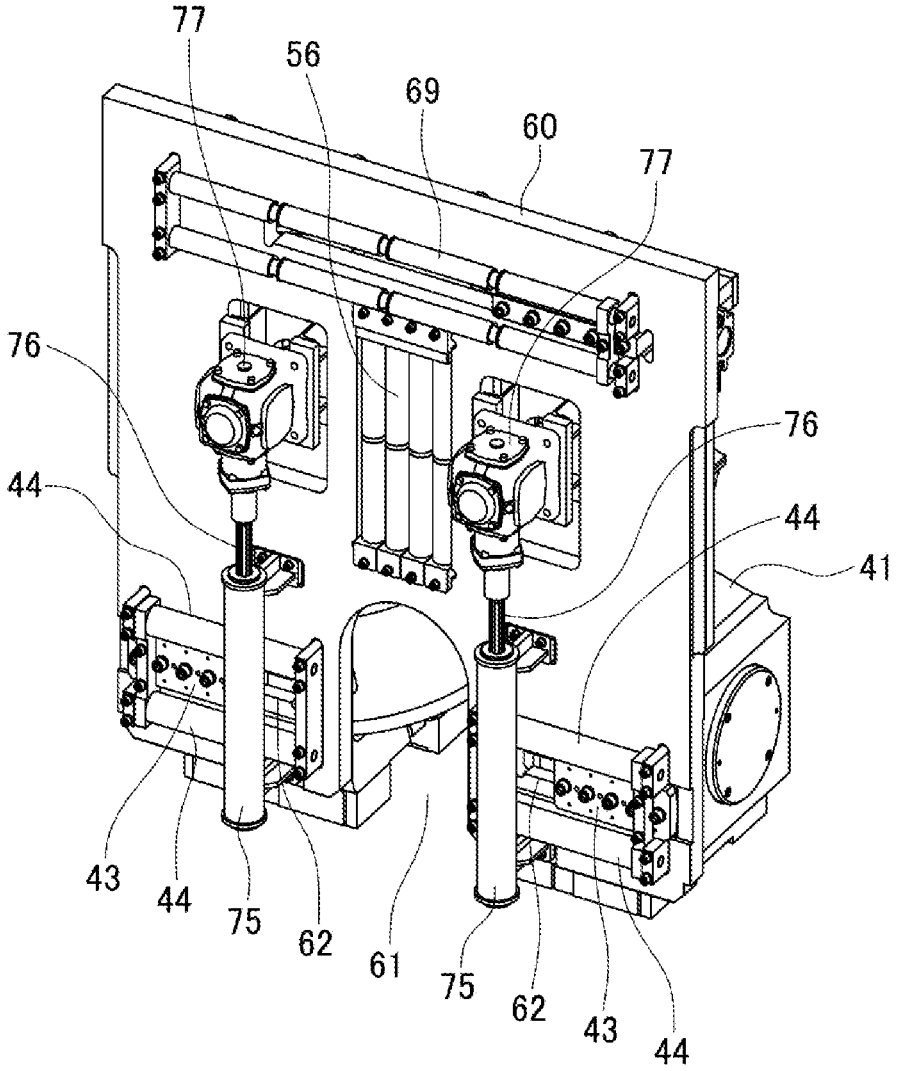
FIG. 19 is an enlarged perspective view of the roll support plate from the back.
Figure 20:
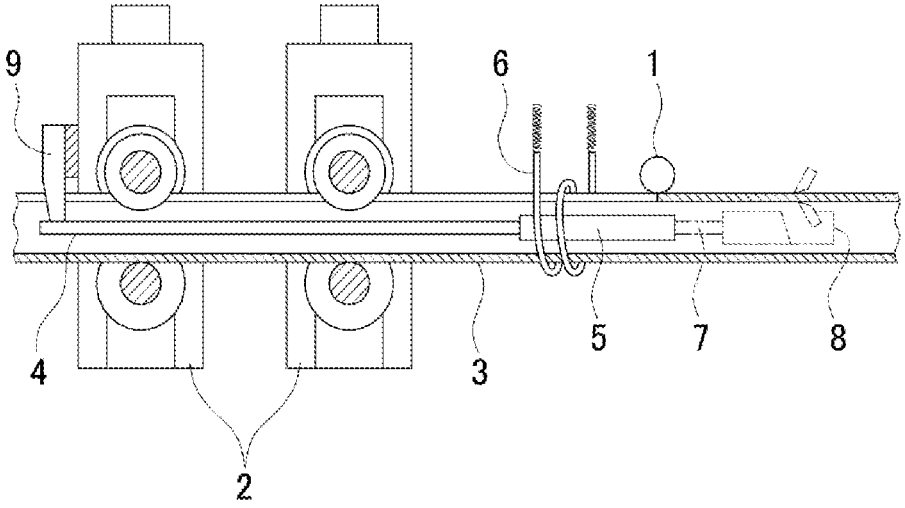
FIG. 20 is a configuration explanatory view and a schematic side view of a mandrel bar installed on a squeeze device.

As shown in FIGS. 18 and 19, the roll yoke 41 for the side roll 40 is fastened with a bolt to the slide block 43 fitted in the horizontally-long guide hole 62 formed at the roll support plate 60. The slide block 43 is elastically held outwardly by the upper and lower return mechanisms 44, 44 in a pair with built-in horizontal springs mounted on the back surface of the roll support plate 60. By doing so, each side roll 40 is biased outwardly in a manner attachable and detachable to and from the roll support plate 60 and movable in a horizontal direction.

The split-type upper rolls 50, 50 are tilted rolls with the respective support shafts 53, 53 tilted outwardly from the horizon. The respective roll yokes 52, 52 for the split-type upper rolls 50, 50 are detachably mounted on the slidable upper roll mounting plate 54 arranged as a sub surface plate on the front side of an upper part of the roll support plate 60 as a main surface plate. The upper roll mounting plate 54 is supported slidably by the vertical guides 55, 55 on the opposite sides and is elastically held upwardly by the return mechanism 56 with a built-in vertical spring extending in a vertical direction mounted on the roll support plate 60. By doing so, the upper rolls 50, 50 become attachable and detachable to and from the roll yokes 52, 52 and the roll yokes 52, 52 are biased upwardly in a manner movable relative to the upper roll mounting plate 54.

The roll support plate 60 supporting a group of these rolls is fixed in the U-shaped fixed stand 10 by clamp mechanisms 35, 35 mounted on the upper surfaces of the opposite side sections 11B, 11B of the U-shaped fixed stand 10. The clamp mechanisms 35, 35 form the retaining mechanism 30 of the roll support plate 60 described above. Each of the clamp mechanisms 35, 35 has a stopper pushed inwardly with a horizontal inwardly-pointed cylinder 36 to be engaged with a tapered receiver 37 mounted on the front of the roll support plate 60, thereby downwardly pressing and fixing the roll support plate 60.

Like in the squeeze devices of the other embodiments, the roll support plate 60 has the space 61 for passage of the pipe-shaped material formed at a lower part of the roll support plate 60. Like in the squeeze device of the second embodiment, the space 61 is a part (here, an upper part) of a cutout-shaped opening opened downwardly.

While the slidable upper roll mounting plate 54 arranged as a sub surface plate on the front side of the roll support plate 60 is movable in a top-bottom direction and biased upwardly as described above, the upper roll mounting plate 54 is pressed downwardly and fixed with a wedge-shaped slider 67 extending in a horizontal direction arranged on the front of the top of the roll support plate 60. Specifically, the wedge-shaped slider 67 extending in a horizontal direction is movable along a horizontal guide 68 mounted on the front of the top of the roll support plate 60, is elastically held at an outer initial position by a spring-type return mechanism 69 extending in a horizontal direction mounted on the back surface of the roll support plate 60, and is forcedly pressed inwardly by the second screw down device 70B composed of a jack extending in a horizontal direction installed above one of the clamp mechanisms 35, 35, thereby pressing the upper roll mounting plate 54 downwardly against upward biasing force to screw down the split-type upper rolls 50, 50.

The upper rolls 50, 50 are combined with respective jacks 79, 79 for adjusting screw down positions. In order to screw down the roll yoke 52 for the upper roll 50 directly as a target, each of the jacks 79 is mounted together with this upper roll 50 on the front of the upper roll mounting plate 54 and is driven by a driving mechanism 72 extending from the back surface of the roll support plate 60 to the back surface of the U-shaped fixed stand 10.

Figure 12:
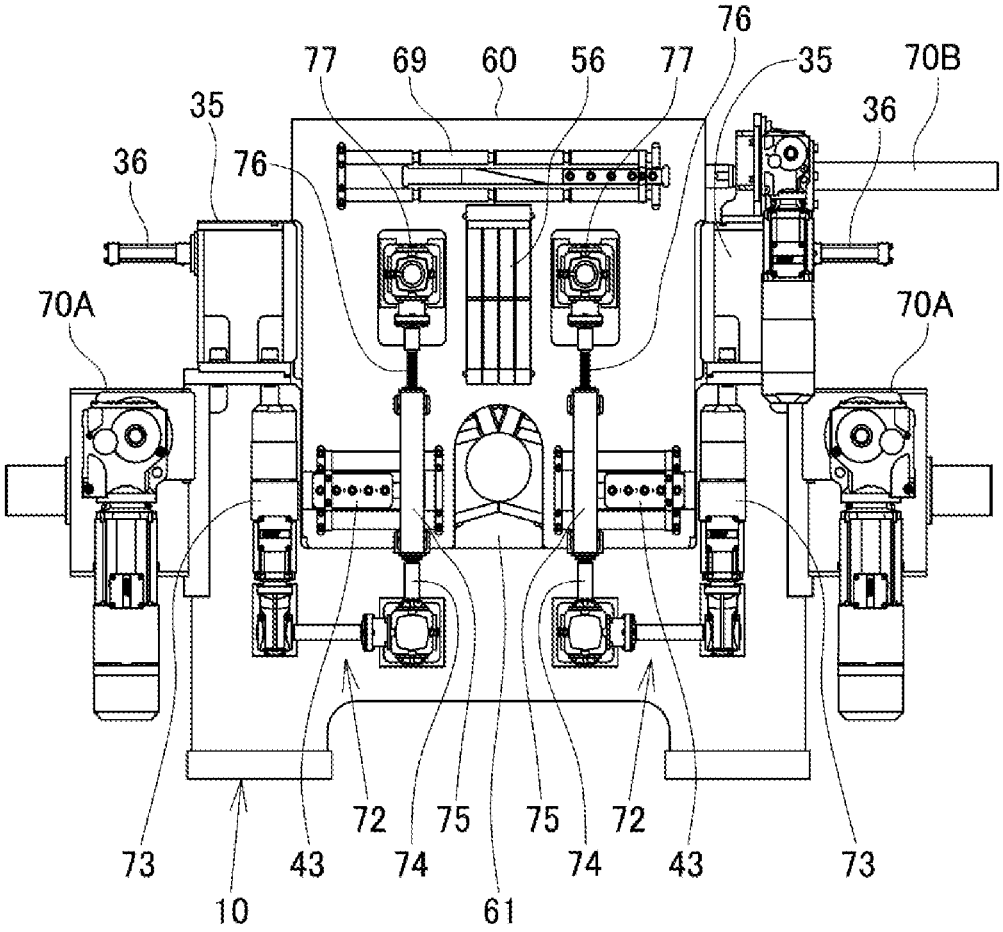
FIG. 12 is a back view of the squeeze device.
Figure 13:
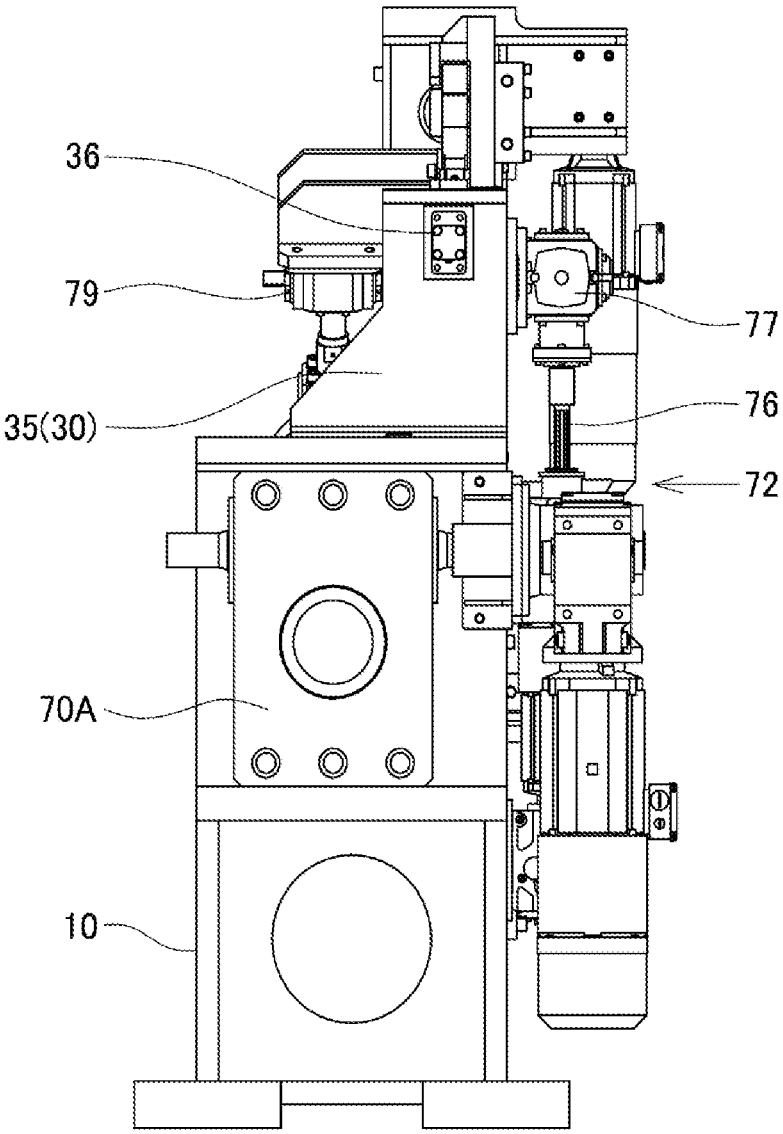
FIG. 13 is a side view of the squeeze device.
Figure 14:
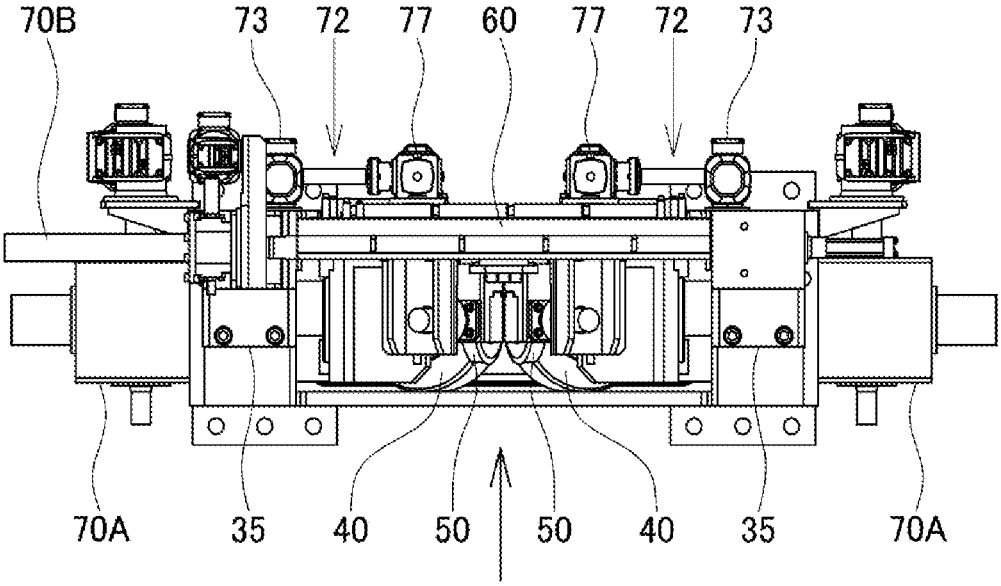
FIG. 14 is a plan view of the squeeze device.
Figure 15:
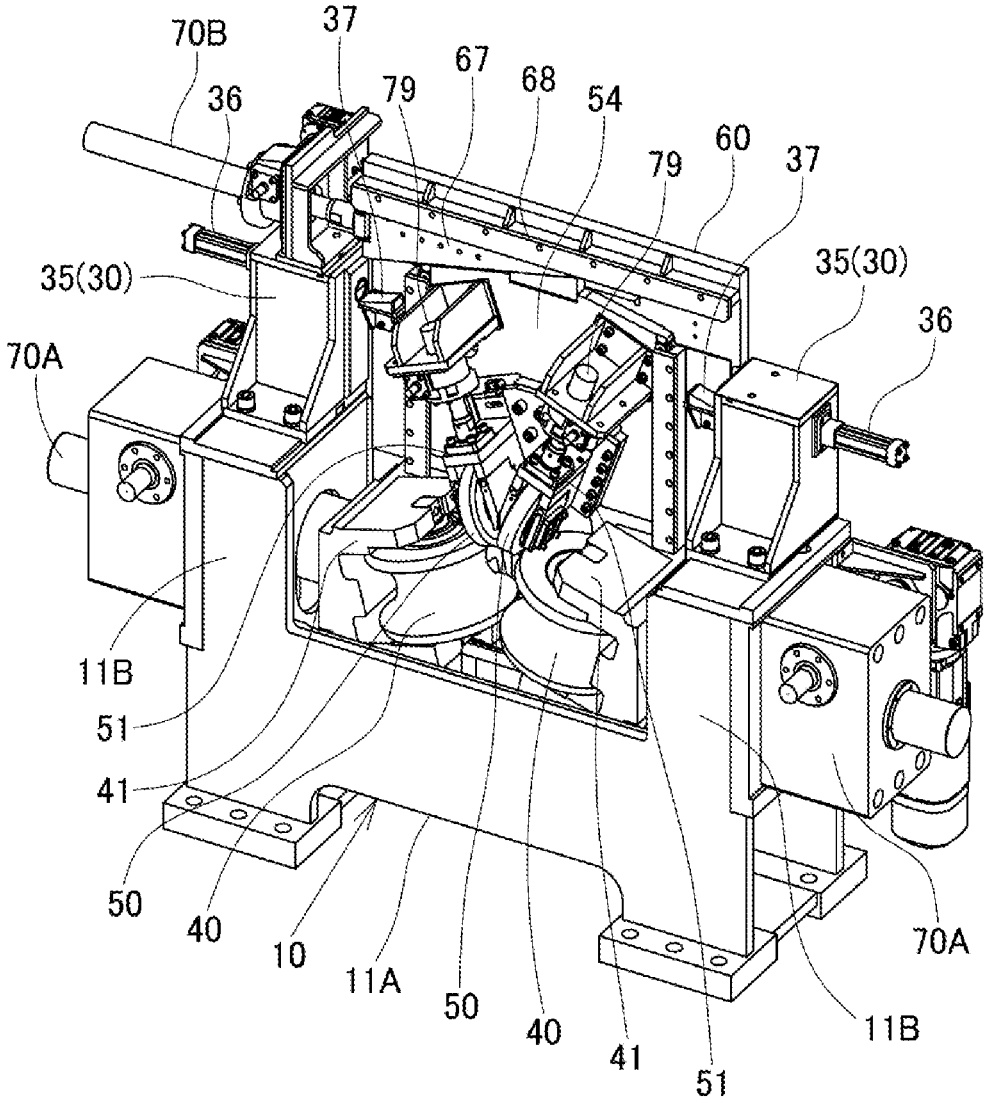
FIG. 15 is a perspective view of the squeeze device from the front.
Figure 16:
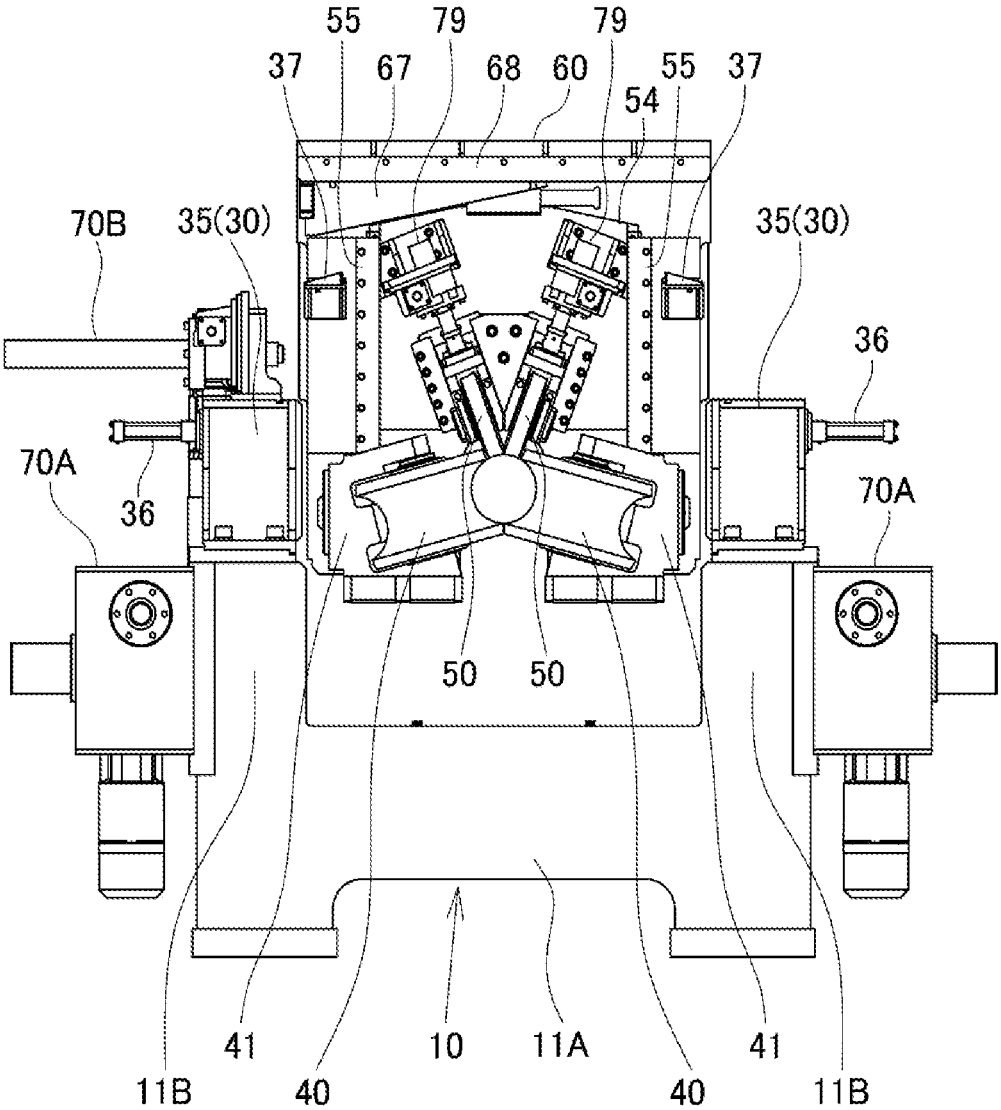
FIG. 16 is a front view of the squeeze device showing a state where a roll support plate is pulled up upwardly.
Figure 17:
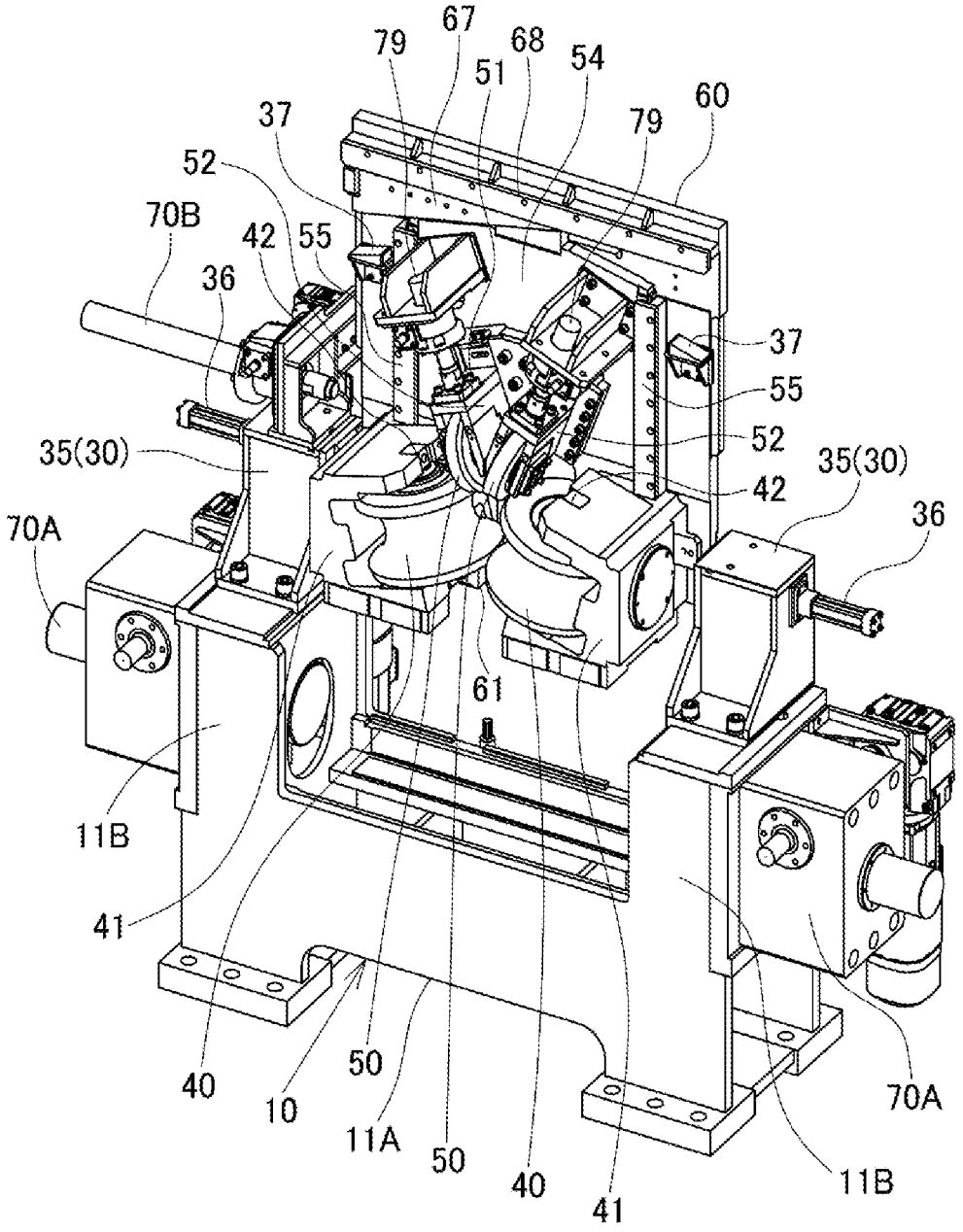
FIG. 17 is a perspective view of the squeeze device from the front showing a state where the roll support plate is pulled up upwardly.

As clearly shown in FIG. 12, each driving mechanism 72 is configured to transmit the turning force of a motor 73 mounted on the back surface of the U-shaped fixed stand 10 to a vertical and upwardly-pointed output shaft 74 also mounted on the back surface of the U-shaped fixed stand 10, and to transmit resultant rotation of the output shaft 74 to a rotary transmission shaft 75 mounted vertically on the back surface of a lower part of the roll support plate 60. The rotary transmission shaft 75 has a dual structure with a rotary main shaft (first rotary shaft) inserted into a fixed sleeve. With the roll support plate 60 placed in the U-shaped fixed stand 10, the rotary main shaft (first rotary shaft) is located directly above the output shaft 74 and is coupled to an upper part of the output shaft 74 by fitting. The rotation of the rotary main shaft (first rotary shaft) is transmitted to a second rotary shaft 76 slidably coupled to an upper part of the rotary main shaft (first rotary shaft) and is transmitted to the jack 79 arranged on the front side of the upper roll mounting plate 54 through a direction changing gear 77.

In this way, the jack 79 for screw down position adjustment arranged on the front side of the upper roll mounting plate 54 is driven by the rotation of the motor 73 mounted on the back surface of the U-shaped fixed stand 10. The roll support plate 60 is pulled out of the U-shaped fixed stand 10 by separating the rotary transmission shaft 75 from the output shaft 74. Upward and downward motions of the upper roll mounting plate 54 relative to the roll support plate 60 are absorbed by the sliding motion in an axis direction of the second rotary shaft 76.

Like in the squeeze device of the first embodiment and the squeeze device of the second embodiment described above, the first screw down devices 70A, 70A for screwing down the side rolls 40, 40 on the opposite sides are motor-driven jacks mounted on the outer side surfaces of the side sections 11B, 11B on the opposite sides of the U-shaped fixed stand 10. The other structures are substantially equal to those of the squeeze device of the first embodiment and those of the squeeze device of the second embodiment.

The squeeze device of the third embodiment having the above-described configuration is used and functions as follows.

Like the squeeze device of the first embodiment and the squeeze device of the second embodiment, this squeeze device is installed with its front pointed toward a line upstream side. Then, with the clamp mechanisms 34, 34 installed on the opposite side sections 11B, 11B of the U-shaped fixed stand 10 opened toward the opposite sides, the roll support plate 60 is inserted into the U-shaped fixed stand 10 and the clamp mechanisms 34, 34 are driven to move to inner closing positions, thereby placing the side rolls 40, 40 on the opposite sides and the split-type upper rolls 50, 50 in the U-shaped fixed stand 10.

Furthermore, the wedge-shaped slider 67 is forcedly pressed inwardly by the second screw down device 70B composed of a cylinder extending in a horizontal direction to press down the upper roll mounting plate 54 against biasing force acting upwardly, thereby setting predetermined screw down amounts on the split-type upper rolls 50, 50. At this time, by using the jacks 79, 79 for adjustment of screw down positions combined with the upper rolls 50, 50, screw down amounts are finely adjusted individually for the upper rolls 50, 50, thereby adjusting an edge butting state and lapping of a pipe-shaped material. Also, the side rolls 40, 40 on the opposite sides are subjected to setting of predetermined screw down amounts made by the first screw down devices 70A, 70A on the opposite sides against biasing force.

Then, in this state, the pipe-shaped material with heated opposite edge portions goes into the squeeze device from the front side and these opposite edge portions are pressed with the side rolls 40, 40 on the opposite sides and the split-type upper rolls 50, 50 to a predetermined screw down amount to be welded. At this time, the pipe-shaped material passes through the space 61 of the roll support plate 60. A mandrel bar for inner bead cutting is placed in the space 61 while being located inside the pipe-shaped material.

For roll changing, after the pipe-shaped material goes out of the squeeze device, the screw down by the first screw down devices 70A, 70A is reset and the screw down by the second screw down device 70B is reset. This makes the side rolls 40, 40 on the opposite sides return to outer initial positions and makes the upper rolls 50 return to upper initial positions. Furthermore, the second screw down device 70B composed of a jack extending in a horizontal direction is released to make the wedge-shaped slider 67 return to an outer initial position autonomously. By doing so, the upper roll mounting plate 54 returns to an upper initial position autonomously.

Then, the clamp mechanisms 34, 34 installed on the U-shaped fixed stand 10 are driven to move to open positions on the opposite sides, and the roll support plate 60 is lifted with a crane to take the roll support plate 60 together with the side rolls 40, 40 on the opposite sides and the split-type upper rolls 50, 50 out of the U-shaped fixed stand 10.

At this time, like in the squeeze device of the second embodiment, the space 61 of the roll support plate 60 for passage of the pipe-shaped material is a part (here, an upper part) of the cutout-shaped opening opened downwardly. Furthermore, a squeeze roll is composed of the side rolls 40, 40 on the opposite sides and the split-type upper rolls 50, 50 and a lower roll is omitted. This eliminates the need of detaching a mandrel bar for an impeder and for an inner bead cutter placed in the space 51 during roll changing. As a result, operation of the roll changing is performed more simply and more speedily.

After the roll support plate 60 is placed in the U-shaped fixed stand 10, the clamp mechanisms 34, 34 installed on the U-shaped fixed stand 10 are driven to move to the inner closing positions and the wedge-shaped slider 67 is driven to move to an inner fixed position, thereby making preparation for next pipe manufacture.

As described above, in the squeeze device of the third embodiment, roll changing of the side rolls 40, 40 and the upper rolls 50 is done extremely easily. As the squeeze roll has a four-direction roll configuration including the side rolls 40, 40 and the upper rolls 50, 50, the device configuration is simplified. Moreover, unlike in the squeeze device of the first embodiment and the squeeze device of the second embodiment, the open-close lid 39 as the retaining mechanism 30 for the roll support plate 60 for closing the open top of the U-shaped fixed stand 10 is not provided so the open top remains opened. This achieves weight reduction of the device.

Regarding the side rolls 40, 40 on the opposite sides, in the squeeze device of the first embodiment and the squeeze device of the second embodiment, a different-diameter roll in which a lower flange has a larger diameter than an upper flange is used for supporting a pipe-shaped material without a lower roll. This causes problems in terms of increase in roll weight, occurrence of a roll scar, increase in a distance from a work coil for welding to a welding point, and increase in thrust force. By contrast, in the squeeze device of the third embodiment, each of the side rolls 40, 40 on the opposite sides is an equal-diameter roll in which an upper flange and a lower flange are equal in outer diameter to resolve these problems.

Additionally, the side rolls 40, 40 each having an equal diameter are tilted rolls with their respective support shafts 41, 41 tilted outwardly toward a higher position. Thus, even with the equal-diameter rolls, a pipe-shaped material is still effectively supported from diagonally below. Use of the tilted rolls as the side rolls 40, 40 is possible for the reason that, as a lower roll is omitted, no interference with a lower roll occurs.

While the three embodiments have been described above, the present invention is applicable to any pipe size and is effective particularly for squeeze devices for middle-diameter pipes and squeeze devices for large-diameter pipes in which five-direction rolls are conventionally used. More specifically, of the three embodiments, the first embodiment is preferably applicable to squeeze devices for small-diameter pipes of relatively small diameters (from 2 to 3 inches) in which an inner bead cutter is not used, the second embodiment is preferably applicable to squeeze devices for small-diameter pipes of relatively larger diameters (from 3 to 4 inches), and the third embodiment is preferably applicable to squeeze devices for middle-diameter pipes and for large-diameter pipes of equal to or greater than 5 inches.

| Reference Signs List | |
|---|---|
| 10 | U-shaped fixed stand |
| 11A | Lower section |
| 11B | Side section |
| 12A | Second engagement part |
| 12B | Third engagement part |
| 20 | Fixed base |
| 30 | Retaining mechanism |
| 31 | Support shaft |
| 32 | Cylinder |
| 33 | Lock mechanism |
| 34 | First engagement part |
| 35 | Clamp mechanism (retaining mechanism) |
| 36 | Cylinder |
| 37 | Receiver |
| 39 | Open-close lid (retaining mechanism) |
| 40 | Side roll |
| 41 | Roll yoke |
| 42 | Support shaft |
| 43 | Slide block |
| 44 | Return mechanism |
| 50 | Upper roll |
| 51 | Annular groove |
| 52 | Roll yoke |
| 53 | Support shaft |
| 54 | Upper roll mounting plate (sub surface plate) |

-continued

| Reference Signs List | |
|---|---|
| 55 | Vertical guide |
| 56 | Return mechanism |
| 59 | Fixture |
| 60 | Roll support plat (main surface plate) |
| 61 | Space |
| 62 | Guide hole |
| 67 | Wedge-shaped slider |
| 68 | Horizontal guide |
| 69 | Return mechanism |
| 70A | First screw down device |
| 71A | Motor |
| 70B | Second screw down device |
| 71B | Motor |
| 72 | Driving mechanism |
| 73 | Motor |
| 74 | Output shaft |
| 75 | Rotary transmission shaft |
| 76 | Second rotary shaft |
| 77 | Direction changing gear |
| 79 | Jack for screw down position adjustment |

The invention claimed is:

1. A squeeze device configured to be arranged in an electric resistance welded pipe manufacturing line in which an impeder support mandrel is inserted and fixed in an open pipe in a direction from a line upstream side toward a position directly below a squeeze roll, the open pipe being along a pipe manufacturing line in which a forming material is to pass, comprising:

a U-shaped fixed stand having a U shape with an open top, the electric resistance welded pipe manufacturing line passing through a middle of the U shape;

a roll support plate composed of a slidable surface plate insertable into and extractable from an inside of the U-shaped fixed stand through the open top of the U-shaped fixed stand in a vertical direction, the roll support plate having an upstream-side main surface; and a squeeze roll mounted on the upstream-side main surface of the roll support plate and consisting of an upper roll and right and left side rolls configured to be screwed down toward the pipe-shaped material, the upper roll having a configuration with one roll for pressing butting edge portions of the pipe-shaped material from directly above or a configuration with two rolls each for pressing the butting edge portions from diagonally above, the right and left side rolls each having a roll shaft that is a vertical shaft or a tilted shaft tilted outwardly toward a higher position, the roll support plate having space for passage of the pipe-shaped material formed at a position surrounded by the side rolls and the upper roll, the squeeze roll not being mounted with a lower roll, wherein the U-shaped fixed stand is mounted with a first screw down device configured to inwardly screw down the right and left side rolls and a second screw down device configured to downwardly screw down the upper roll, the squeeze roll becomes changeable by extracting the roll support plate upwardly above the line through the open top of the U-shaped fixed stand without moving the impeder support mandrel in the open pipe, and the squeeze device further comprises an open-close lid that fixes the roll support plate in the U-shaped fixed stand after the roll support plate is inserted into the U-shaped fixed stand and closes the open top of the U-shaped fixed stand in a manner allowing the open top to be opened.

2. The squeeze device according to claim 1, wherein the surface plate of the roll support plate is provided with a cutout formed under the space for passage of the pipe-shaped material and opened downwardly from the space.

3. The squeeze device according to claim 1, wherein the open-close lid functions as a mounting base for the second screw down device.

4. The squeeze device according to claim 1, further comprising:

right and left clamp mechanisms in a pair that fix the roll support plate in the U-shaped fixed stand after the roll support plate is inserted into the U-shaped fixed stand and are mounted on respective side sections of the U-shaped fixed stand and engaged with respective side edges of the roll support plate inserted in the U-shaped fixed stand.

5. The squeeze device according to claim 4, wherein the second screw down device is a combination including:

a screw down device main body mounted on a slidable upper roll mounting plate supported in such a manner as to be movable up and down along one main surface of the roll support plate; and a driving mechanism for the main body formed on the side of an opposite surface of the roll support plate or formed on the side of an opposite surface from the roll support plate to the U-shaped fixed stand.

6. The squeeze device according to claim 1, wherein the U shape of the U-shaped fixed stand is perpendicular to the electric resistance welded pipe manufacturing line.

7. The squeeze device according to claim 1, wherein the surface plate of the roll support plate has a cutout opened at the bottom of the surface plate and having a space through which the electric resistance welded pipe manufacturing line passes.

* * * * *